US008779879B2

(12) United States Patent
Roberts et al.

(10) Patent No.: US 8,779,879 B2
(45) Date of Patent: Jul. 15, 2014

(54) SYSTEM AND METHOD FOR POSITIONING A MULTI-POLE MAGNETIC STRUCTURE

(71) Applicant: Correlated Magnetics Research LLC, New Hope, AL (US)

(72) Inventors: Mark D. Roberts, Huntsville, AL (US); Larry W. Fullerton, New Hope, AL (US); James Lee Richards, Fayetteville, TN (US)

(73) Assignee: Correlated Magnetics Research LLC, Huntsville, AL (US)

( * ) Notice: Subject to any disclaimer, the term of this patent is extended or adjusted under 35 U.S.C. 154(b) by 0 days.

(21) Appl. No.: 14/086,924

(22) Filed: Nov. 21, 2013

(65) Prior Publication Data

US 2014/0145809 A1 May 29, 2014

Related U.S. Application Data

(63) Continuation-in-part of application No. 14/035,818, filed on Sep. 24, 2013, which is a continuation-in-part (Continued)

(51) Int. Cl.
*H01F 7/20* (2006.01)
*H01F 7/02* (2006.01)

(52) U.S. Cl.
CPC ..... *H01F 7/0252* (2013.01); *H01F 7/021* (2013.01)
USPC ..... 335/306; 335/285

(58) Field of Classification Search
CPC ..... H01F 7/021; H01F 7/0252
USPC ..... 335/285, 306
See application file for complete search history.

(56) References Cited

U.S. PATENT DOCUMENTS 381,968 A 5/1888 Tesla
493,858 A 3/1893 Edison (Continued)

FOREIGN PATENT DOCUMENTS

CN 1615573 A 5/2005
DE 2938782 A1 4/1981

(Continued)

OTHER PUBLICATIONS

United States Office Action issued in U.S. Appl. No. 13/470,994 dated Aug. 8, 2013.

(Continued)

*Primary Examiner* — Ramon Barrera
(74) *Attorney, Agent, or Firm* — James Richards

(57) ABSTRACT

Systems and methods for arranging magnetic sources for producing field patterns having high gradients for precision positioning, position sensing, and pulse generation. Magnetic fields may be arranged in accordance with codes having a maximum positive cross correlation and a maximum negative cross correlation value in proximity in the correlation function, thereby producing a high gradient slope corresponding to a high gradient force or signal associated with the magnetic structure. Various codes for doublet, triplet, and quad peak patterns are disclosed. Applications include force and torque pattern generators. A variation including magnetic sensors is disclosed for precision position sensing. The forces or sensor outputs may have a precision zero crossing between two adjacent and opposite maximum correlation peaks.

23 Claims, 29 Drawing Sheets

Related U.S. Application Data of application No. 13/959,649, filed on Aug. 5, 2013, now Pat. No. 8,692,637, which is a continuation-in-part of application No. 13/759,695, filed on Feb. 5, 2013, now Pat. No. 8,502,630, which is a continuation of application No. 13/481,554, filed on May 25, 2012, now Pat. No. 8,368,495, which is a continuation-in-part of application No. 13/351,203, filed on Jan. 16, 2012, now Pat. No. 8,314,671, which is a continuation of application No. 13/157,975, filed on Jun. 10, 2011, now Pat. No. 8,098,122, which is a continuation of application No. 12/952,391, filed on Nov. 23, 2010, now Pat. No. 7,691,069, which is a continuation of application No. 12/478,911, filed on Jun. 5, 2009, now Pat. No. 7,843,295, which is a continuation-in-part of application No. 12/476,952, filed on Jun. 2, 2009, now Pat. No. 8,179,219, which is a continuation-in-part of application No. 12/322,561, filed on Feb. 4, 2009, now Pat. No. 8,115,581, said application No. 12/952,391 is a continuation of application No. 12/478,950, filed on Jun. 5, 2009, now Pat. No. 7,843,296, which is a continuation-in-part of application No. 12/476,952, filed on Jun. 2, 2009, now Pat. No. 8,179,219, which is a continuation-in-part of application No. 12/322,561, filed on Feb. 4, 2009, now Pat. No. 8,115,581, said application No. 12/952,391 is a continuation of application No. 12/478,969, filed on Jun. 5, 2009, now Pat. No. 7,843,297, which is a continuation-in-part of application No. 12/476,952, filed on Jun. 2, 2009, now Pat. No. 8,179,219, which is a continuation-in-part of application No. 12/322,561, filed on Feb. 4, 2009, now Pat. No. 8,115,581, said application No. 12/952,391 is a continuation of application No. 12/479,013, filed on Jun. 5, 2009, now Pat. No. 7,839,247, which is a continuation-in-part of application No. 12/476,952, filed on Jun. 2, 2009, now Pat. No. 8,179,219, which is a continuation-in-part of application No. 12/322,561, filed on Feb. 4, 2009, now Pat. No. 8,115,581.

(60) Provisional application No. 61/796,863, filed on Nov. 21, 2012, provisional application No. 61/744,342, filed on Sep. 24, 2012, provisional application No. 61/519,664, filed on May 25, 2011.

(56) References Cited

U.S. PATENT DOCUMENTS

| | | | |
|---|---|---|---|
| 687,292 | A | 11/1901 | Armstrong |
| 996,933 | A | 7/1911 | Lindquist |
| 1,171,351 | A | 2/1916 | Neuland |
| 1,236,234 | A | 8/1917 | Troje |
| 2,243,555 | A | 5/1941 | Faus |
| 2,389,298 | A | 11/1945 | Ellis |
| 2,438,231 | A | 3/1948 | Shultz |
| 2,471,634 | A | 5/1949 | Vennice |
| 2,570,625 | A | 10/1951 | Zimmerman et al. |
| 2,722,617 | A | 11/1955 | Cluwen et al. |
| 3,055,999 | A | 9/1962 | Lucas |
| 3,102,314 | A | 9/1963 | Alderfer |
| 3,208,296 | A | 9/1965 | Baermann |
| 3,238,399 | A | 3/1966 | Johanees et al. |
| 3,288,511 | A | 11/1966 | Tavano |
| 3,301,091 | A | 1/1967 | Reese |
| 3,382,386 | A | 5/1968 | Schlaeppi |
| 3,408,104 | A | 10/1968 | Raynes |
| 2,932,545 | A | 4/1969 | Foley |
| 3,468,576 | A | 9/1969 | Beyer et al. |
| 3,474,366 | A | 10/1969 | Barney |
| 3,521,216 | A | 7/1970 | Tolegian |
| 3,645,650 | A | 2/1972 | Laing |
| 3,668,670 | A | 6/1972 | Andersen |
| 3,684,992 | A | 8/1972 | Huguet et al. |
| 3,696,258 | A | 10/1972 | Anderson et al. |
| 3,790,197 | A | 2/1974 | Parker |
| 3,791,309 | A | 2/1974 | Baermann |
| 3,802,034 | A | 4/1974 | Bookless |
| 3,803,433 | A | 4/1974 | Ingenito |
| 3,808,577 | A | 4/1974 | Mathauser |
| 3,845,430 | A | 10/1974 | Petkewicz et al. |
| 3,893,059 | A | 7/1975 | Nowak |
| 4,079,558 | A | 3/1978 | Forham |
| 4,117,431 | A | 9/1978 | Eicher |
| 4,129,846 | A | 12/1978 | Yablochnikov |
| 4,209,905 | A | 7/1980 | Gillings |
| 4,222,489 | A | 9/1980 | Hutter |
| 4,296,394 | A | 10/1981 | Ragheb |
| 4,352,960 | A | 10/1982 | Dormer et al. |
| 4,399,595 | A | 8/1983 | Yoon et al. |
| 4,416,127 | A | 11/1983 | Gomez-Olea Naveda |
| 4,453,294 | A | 6/1984 | Morita |
| 4,535,278 | A | 8/1985 | Asakawa |
| 4,547,756 | A | 10/1985 | Miller et al. |
| 4,629,131 | A | 12/1986 | Podell |
| 4,645,283 | A | 2/1987 | MacDonald et al. |
| 4,680,494 | A | 7/1987 | Grosjean |
| 4,837,539 | A | 6/1989 | Baker |
| 4,849,749 | A | 7/1989 | Fukamachi et al. |
| 4,912,727 | A | 3/1990 | Schubert |
| 4,941,236 | A | 7/1990 | Sherman et al. |
| 4,956,625 | A | 9/1990 | Cardone et al. |
| 4,993,950 | A | 2/1991 | Mensor, Jr. |
| 4,996,457 | A | 2/1991 | Hawsey et al. |
| 5,013,949 | A | 5/1991 | Mabe, Jr. |
| 5,020,625 | A | 6/1991 | Yamauchi et al. |
| 5,050,276 | A | 9/1991 | Pemberton |
| 5,062,855 | A | 11/1991 | Rincoe |
| 5,123,843 | A | 6/1992 | Van der Zel et al. |
| 5,179,307 | A | 1/1993 | Porter |
| 5,302,929 | A | 4/1994 | Kovacs |
| 5,309,680 | A | 5/1994 | Kiel |
| 5,345,207 | A | 9/1994 | Gebele |
| 5,367,891 | A | 11/1994 | Furuyama |
| 5,383,049 | A | 1/1995 | Carr |
| 5,394,132 | A | 2/1995 | Poil |
| 5,425,763 | A | 6/1995 | Stemmann |
| 5,440,997 | A | 8/1995 | Crowley |
| 5,461,386 | A | 10/1995 | Knebelkamp |
| 5,492,572 | A | 2/1996 | Schroeder et al. |
| 5,495,221 | A | 2/1996 | Post |
| 5,512,732 | A | 4/1996 | Yagnik et al. |
| 5,570,084 | A | 10/1996 | Ritter et al. |
| 5,582,522 | A | 12/1996 | Johnson |
| 5,604,960 | A | 2/1997 | Good |
| 5,631,093 | A | 5/1997 | Perry et al. |
| 5,631,618 | A | 5/1997 | Trumper et al. |
| 5,633,555 | A | 5/1997 | Ackermann et al. |
| 5,635,889 | A | 6/1997 | Stelter |
| 5,637,972 | A | 6/1997 | Randall et al. |
| 5,730,155 | A | 3/1998 | Allen |
| 5,759,054 | A | 6/1998 | Spadafore |
| 5,788,493 | A | 8/1998 | Tanaka et al. |
| 5,838,304 | A | 11/1998 | Hall |
| 5,852,393 | A | 12/1998 | Reznik et al. |
| 5,935,155 | A | 8/1999 | Humayun et al. |
| 5,956,778 | A | 9/1999 | Godoy |
| 5,983,406 | A | 11/1999 | Meyerrose |
| 6,039,759 | A | 3/2000 | Carpentier et al. |
| 6,047,456 | A | 4/2000 | Yao et al. |
| 6,072,251 | A | 6/2000 | Markle |
| 6,074,420 | A | 6/2000 | Eaton |
| 6,115,849 | A | 9/2000 | Meyerrose |
| 6,118,271 | A | 9/2000 | Ely et al. |
| 6,120,283 | A | 9/2000 | Cousins |
| 6,142,779 | A | 11/2000 | Siegel et al. |
| 6,170,131 | B1 | 1/2001 | Shin |
| 6,187,041 | B1 | 2/2001 | Garonzik |

(56) References Cited

U.S. PATENT DOCUMENTS

| | | | |
|---|---|---|---|
| 6,205,012 | B1 | 3/2001 | Lear |
| 6,210,033 | B1 | 4/2001 | Karkos, Jr. et al. |
| 6,224,374 | B1 | 5/2001 | Mayo |
| 6,234,833 | B1 | 5/2001 | Tsai et al. |
| 6,273,918 | B1 | 8/2001 | Yuhasz et al. |
| 6,275,778 | B1 | 8/2001 | Shimada et al. |
| 6,285,097 | B1 | 9/2001 | Hazelton et al. |
| 6,387,096 | B1 | 5/2002 | Hyde, Jr. |
| 6,457,179 | B1 | 10/2002 | Prendergast |
| 6,467,326 | B1 | 10/2002 | Garrigus |
| 6,540,515 | B1 | 4/2003 | Tanaka |
| 6,599,321 | B2 | 7/2003 | Hyde, Jr. |
| 6,607,304 | B1 | 8/2003 | Lake et al. |
| 6,652,278 | B2 | 11/2003 | Honkura et al. |
| 6,653,919 | B2 | 11/2003 | Shih-Chung et al. |
| 6,720,698 | B2 | 4/2004 | Galbraith |
| 6,747,537 | B1 | 6/2004 | Mosteller |
| 6,842,332 | B1 | 1/2005 | Rubenson et al. |
| 6,847,134 | B2 | 1/2005 | Frissen et al. |
| 6,850,139 | B1 | 2/2005 | Dettmann et al. |
| 6,862,748 | B2 | 3/2005 | Prendergast |
| 6,913,471 | B2 | 7/2005 | Smith |
| 6,927,657 | B1 | 8/2005 | Wu |
| 6,954,938 | B2 | 10/2005 | Emberty et al. |
| 6,954,968 | B1 | 10/2005 | Sitbon |
| 6,971,147 | B2 | 12/2005 | Halstead |
| 7,016,492 | B2 | 3/2006 | Pan et al. |
| 7,031,160 | B2 | 4/2006 | Tillotson |
| 7,033,400 | B2 | 4/2006 | Currier |
| 7,065,860 | B2 | 6/2006 | Aoki et al. |
| 7,066,739 | B2 | 6/2006 | McLeish |
| 7,066,778 | B2 | 6/2006 | Kretzschmar |
| 7,101,374 | B2 | 9/2006 | Hyde, Jr. |
| 7,137,727 | B2 | 11/2006 | Joseph et al. |
| 7,186,265 | B2 | 3/2007 | Sharkawy et al. |
| 7,224,252 | B2 | 5/2007 | Meadow, Jr. et al. |
| 7,264,479 | B1 | 9/2007 | Lee |
| 7,276,025 | B2 | 10/2007 | Roberts et al. |
| 7,339,790 | B2 | 3/2008 | Baker et al. |
| 7,362,018 | B1 | 4/2008 | Kulogo et al. |
| 7,381,181 | B2 | 6/2008 | Lau et al. |
| 7,402,175 | B2 | 7/2008 | Azar |
| 7,438,726 | B2 | 10/2008 | Erb |
| 7,444,683 | B2 | 11/2008 | Prendergast et al. |
| 7,453,341 | B1 | 11/2008 | Hildenbrand |
| 7,498,914 | B2 | 3/2009 | Miyashita et al. |
| 7,583,500 | B2 | 9/2009 | Ligtenberg et al. |
| 7,775,567 | B2 | 8/2010 | Ligtenberg et al. |
| 7,796,002 | B2 | 9/2010 | Hashimoto et al. |
| 7,808,349 | B2 | 10/2010 | Fullerton et al. |
| 7,812,697 | B2 | 10/2010 | Fullerton et al. |
| 7,817,004 | B2 | 10/2010 | Fullerton et al. |
| 7,832,897 | B2 | 11/2010 | Ku |
| 7,837,032 | B2 | 11/2010 | Smeltzer |
| 7,839,246 | B2 | 11/2010 | Fullerton et al. |
| 7,843,297 | B2 | 11/2010 | Fullerton et al. |
| 7,868,721 | B2 | 1/2011 | Fullerton et al. |
| 7,874,856 | B1 | 1/2011 | Schriefer et al. |
| 7,903,397 | B2 | 3/2011 | McCoy |
| 7,905,626 | B2 | 3/2011 | Shantha et al. |
| 8,002,585 | B2 | 8/2011 | Zhou |
| 2002/0125977 | A1 | 9/2002 | VanZoest |
| 2003/0170976 | A1 | 9/2003 | Molla et al. |
| 2003/0179880 | A1 | 9/2003 | Pan et al. |
| 2003/0187510 | A1 | 10/2003 | Hyde |
| 2004/0003487 | A1 | 1/2004 | Reiter |
| 2004/0155748 | A1 | 8/2004 | Steingroever |
| 2004/0244636 | A1 | 12/2004 | Meadow et al. |
| 2004/0251759 | A1 | 12/2004 | Hirzel |
| 2005/0102802 | A1 | 5/2005 | Sitbon et al. |
| 2005/0196484 | A1 | 9/2005 | Khoshnevis |
| 2005/0231046 | A1 | 10/2005 | Aoshima |
| 2005/0240263 | A1 | 10/2005 | Fogarty et al. |
| 2005/0263549 | A1 | 12/2005 | Scheiner |
| 2006/0066428 | A1 | 3/2006 | McCarthy et al. |
| 2006/0189259 | A1 | 8/2006 | Park et al. |
| 2006/0198047 | A1 | 9/2006 | Xue et al. |
| 2006/0214756 | A1 | 9/2006 | Elliott et al. |
| 2006/0290451 | A1 | 12/2006 | Prendergast et al. |
| 2006/0293762 | A1 | 12/2006 | Schulman et al. |
| 2007/0072476 | A1 | 3/2007 | Milan |
| 2007/0075594 | A1 | 4/2007 | Sadler |
| 2007/0103266 | A1 | 5/2007 | Wang et al. |
| 2007/0138806 | A1 | 6/2007 | Ligtenberg et al. |
| 2007/0255400 | A1 | 11/2007 | Parravicini et al. |
| 2008/0139261 | A1 | 6/2008 | Cho et al. |
| 2008/0181804 | A1 | 7/2008 | Tanigawa et al. |
| 2008/0186683 | A1 | 8/2008 | Ligtenberg et al. |
| 2008/0218299 | A1 | 9/2008 | Arnold |
| 2008/0224806 | A1 | 9/2008 | Ogden et al. |
| 2008/0272868 | A1 | 11/2008 | Prendergast et al. |
| 2008/0282517 | A1 | 11/2008 | Claro |
| 2009/0021333 | A1 | 1/2009 | Fiedler |
| 2009/0209173 | A1 | 8/2009 | Arledge et al. |
| 2009/0250576 | A1 | 10/2009 | Fullerton et al. |
| 2009/0251256 | A1 | 10/2009 | Fullerton et al. |
| 2009/0254196 | A1 | 10/2009 | Cox et al. |
| 2009/0278642 | A1 | 11/2009 | Fullerton et al. |
| 2009/0289090 | A1 | 11/2009 | Fullerton et al. |
| 2009/0289749 | A1 | 11/2009 | Fullerton et al. |
| 2009/0292371 | A1 | 11/2009 | Fullerton et al. |
| 2010/0033280 | A1 | 2/2010 | Bird et al. |
| 2010/0126857 | A1 | 5/2010 | Polwart et al. |
| 2010/0167576 | A1 | 7/2010 | Zhou |
| 2011/0026203 | A1 | 2/2011 | Ligtenberg et al. |
| 2011/0210636 | A1 | 9/2011 | Kuhlmann-Wilsdorf |
| 2011/0234344 | A1 | 9/2011 | Fullerton et al. |
| 2011/0248806 | A1 | 10/2011 | Michael |
| 2011/0279206 | A1 | 11/2011 | Fullerton et al. |

FOREIGN PATENT DOCUMENTS

| | | | |
|---|---|---|---|
| EP | 0 345 554 | A1 | 12/1989 |
| EP | 0 545 737 | A1 | 6/1993 |
| FR | 823395 | | 1/1938 |
| GB | 1 495 677 | A | 12/1977 |
| JP | 60-091011 | U | 5/1985 |
| WO | WO-02/31945 | A2 | 4/2002 |
| WO | WO-2007/081830 | A2 | 7/2007 |
| WO | WO-2009/124030 | A1 | 10/2009 |
| WO | WO-2010/141324 | A1 | 12/2010 |

OTHER PUBLICATIONS

United States Office Action issued in U.S. Appl. No. 13/430,219 dated Aug. 13, 2013.

Series BNS, Compatible Series AES Safety Controllers, http://www.schmersalusa.com/safety_controllers/drawings/aes.pdf, pp. 159-175, date unknown.

BNS 33 Range, Magnetic safety sensors, Rectangular design, http://www.farnell.com/datasheets/36449.pdf, 3 page, date unknown.

Series BNS-B20, Coded-Magnet Sensor Safety Door Handle, http://www.schmersalusa.com/catalog_pdfs/BNS_B20.pdf, 2 pages, date unknown.

Series BNS333, Coded-Magnet Sensors with Integral Safety Control Module, http://www.schmersalusa.com/machine_guarding/coded_magnet/drawings/bns333.pdf, 2 pages, date unknown.

Wikipedia, "Barker Code", Web article, last modified Aug. 2, 2008, 2 pages.

Wikipedia, "Kasami Code", Web article, last modified Jun. 11, 2008, 1 page.

Wikipedia, "Linear feedback shift register", Web article, last modified Nov. 11, 2008, 6 pages.

Wikipedia, "Golomb Ruler", Web article, last modified Nov. 4, 2008, 3 pages.

Wikipedia, "Costas Array", Web article, last modified Oct. 7, 2008, 4 pages.

Wikipedia, "Walsh Code", Web article, last modified Sep. 17, 2008, 2 pages.

Wikipedia, "Gold Code", Web article, last modified Jul. 27, 2008, 1 page.

(56) References Cited

OTHER PUBLICATIONS

Wikipedia, "Bitter Electromagnet", Web article, last modified Aug. 2011,1 page.
Pill-soo Kim, "A future cost trends of magnetizer systems in Korea", Industrial Electronics, Control, and Instrumentation, 1996, vol. 2, Aug. 5, 1996, pp. 991-996.
United States Office Action, dated Aug. 26, 2011, issued in counterpart U.S. Appl. No. 12/206,271.
United States Office Action, dated Mar. 12, 2012, issued in counterpart U.S. Appl. No. 12/206,271.
United States Office Action, dated Feb. 2, 2011, issued in counterpart U.S. Appl. No. 12/476,952.
United States Office Action, dated Oct. 12, 2011, issued in counterpart U.S. Appl. No. 12/476,952.
United States Office Action, dated Mar. 9, 2012, issued in counterpart U.S. Appl. No. 13/371,280.
International Search Report and Written Opinion, dated May 14, 2009, issued in related International Application No. PCT/US2009/038925.
International Search Report and Written Opinion, dated Jul. 13, 2010, issued in related International Application No. PCT/US2010/021612.
International Search Report and Written Opinion dated Jun. 1, 2009, issued in related International Application No. PCT/US2009/002027.
International Search Report and Written Opinion, dated Aug. 18, 2010, issued in related International Application No. PCT/US2010/036443.
International Search Report and Written Opinion, dated Apr. 8, 2011 issued in related International Application No. PCT/US2010/049410.
Atallah, K., Calverley, S.D., D. Howe, 2004, "Design, analysis and realisation of a high-performance magnetic gear", IEE Proc.-Electr. Power Appl., vol. 151, No. 2, Mar. 2004.
Atallah, K., Howe, D. 2001, "A Novel High-Performance Magnetic Gear", IEEE Transactions on Magnetics, vol. 37, No. 4, Jul. 2001, p. 2844-46.
Bassani, R., 2007, "Dynamic Stability of Passive Magnetic Bearings", Nonlinear Dynamics, V. 50, p. 161-68.
Boston Gear 221S-4, One-stage Helical Gearbox, http://www.bostongear.com/pdf/product_sections/200_series_helical.pdf, referenced Jun. 2010.
Charpentier et al., 2001, "Mechanical Behavior of Axially Magnetized Permanent-Magnet Gears", IEEE Transactions on Magnetics, vol. 37, No. 3, May 2001, p. 1110-17.
Chau et al., 2008, "Transient Analysis of Coaxial Magnetic Gears Using Finite Element Comodeling", Journal of Applied Physics, vol. 103.
Choi et al., 2010, "Optimization of Magnetization Directions in a 3-D Magnetic Structure", IEEE Transactions on Magnetics, vol. 46, No. 6, Jun. 2010, p. 1603-06.
Correlated Magnetics Research, 2009, Online Video, "Innovative Magnetics Research in Huntsville", http://www.youtube.corn/watch?v=m4m81JjZCJo.
Correlated Magnetics Research, 2009, Online Video, "Non-Contact Attachment Utilizing Permanent Magnets", http://www.youtube.com/watch?v=3xUm25CNNgQ.
Correlated Magnetics Research, 2010, Company Website, http://www.correlatedmagnetics.com.
Furlani 1996, "Analysis and optimization of synchronous magnetic couplings", J. Appl. Phys., vol. 79, No. 8, p. 4692.
Furlani 2001, "Permanent Magnet and Electromechanical Devices", Academic Press, San Diego.
Furlani, E.P., 2000, "Analytical analysis of magnetically coupled multipole cylinders", J. Phys. D: Appl. Phys., vol. 33, No. 1, p. 28-33.
General Electric DP 2.7 Wind Turbine Gearbox, http://www.gedrivetrain.com/insideDP27.cfm, referenced Jun. 2010.
Ha et al., 2002, "Design and Characteristic Analysis of Non-Contact Magnet Gear for Conveyor by Using Permanent Magnet", Conf. Record of the 2002 IEEE Industry Applications Conference, p. 1922-27.
Huang et al., 2008, "Development of a Magnetic Planetary Gearbox", IEEE Transactions on Magnetics, vol. 44, No. 3, p. 403-12.
International Search Report and Written Opinion of the International Searching Authority issued in Application No. PCT/US12/61938 dated Feb. 26, 2013.
International Search Report and Written Opinion of the International Searching Authority issued in Application No. PCT/US2013/028095 dated May 13, 2013.
Jian et al., "Comparison of Coaxial Magnetic Gears With Different Topologies", IEEE Transactions on Magnetics, vol. 45, No. 10, Oct. 2009, p. 4526-29.
Jian, L., Chau, K.T., 2010, "A Coaxial Magnetic Gear With Halbach Permanent-Magnet Arrays", IEEE Transactions on Energy Conversion, vol. 25, No. 2, Jun. 2010, p. 319-28.
Jørgensen et al., "The Cycloid Permanent Magnetic Gear", IEEE Transactions on Industry Applications, vol. 44, No. 6, Nov./Dec. 2008, p. 1659-65.
Jørgensen et al., 2005, "Two dimensional model of a permanent magnet spur gear", Conf. Record of the 2005 IEEE Industry Applications Conference, p. 261-5.
Krasil'nikov et al., 2008, "Calculation of the Shear Force of Highly Coercive Permanent Magnets in Magnetic Systems With Consideration of Affiliation to a Certain Group Based on Residual Induction", Chemical and Petroleum Engineering, vol. 44, Nos. 7-8, p. 362-65.
Krasil'nikov et al., 2009, "Torque Determination for a Cylindrical Magnetic Clutch", Russian Engineering Research, vol. 29, No. 6, pp. 544-47.
Liu et al., 2009, "Design and Analysis of Interior-magnet Outer-rotor Concentric Magnetic Gears", Journal of Applied Physics, vol. 105.
Lorimer, W., Hartman, A., 1997, "Magnetization Pattern for Increased Coupling in Magnetic Clutches", IEEE Transactions on Magnetics, vol. 33, No. 5, Sep. 1997.
Mezani, S., Atallah, K., Howe, D. , 2006, "A high-performance axial-field magnetic gear", Journal of Applied Physics vol. 99.
Neugart PlE-160, One-Stage Planetary Gearbox, http://www.neugartusa.com/ple_160_gb.pdf, referenced Jun. 2010.
Notice of Allowance issued in U.S. Appl. No. 13/471,189 dated Apr. 3, 2013.
Tsurumoto 1992, "Basic Analysis on Transmitted Force of Magnetic Gear Using Permanent Magnet", IEEE Translation Journal on Magnetics in Japan, Vo 7, No. 6, Jun. 1992, p. 447-52.
United States Office Action issued in U.S. Appl. No. 13/104,393 dated Apr. 4, 2013.
United States Office Action issued in U.S. Appl. No. 13/236,413 dated Jun. 6, 2013.
United States Office Action issued in U.S. Appl. No. 13/374,074 dated Feb. 21, 2013.
United States Office Action issued in U.S. Appl. No. 13/470,994 dated Jan. 7, 2013.
United States Office Action issued in U.S. Appl. No. 13/529,520 dated Sep. 28, 2012.
United States Office Action issued in U.S. Appl. No. 13/530,893 dated Mar. 22, 2013.
United States Office Action issued in U.S. Appl. No. 13/855,519 dated Jul. 17, 2013.

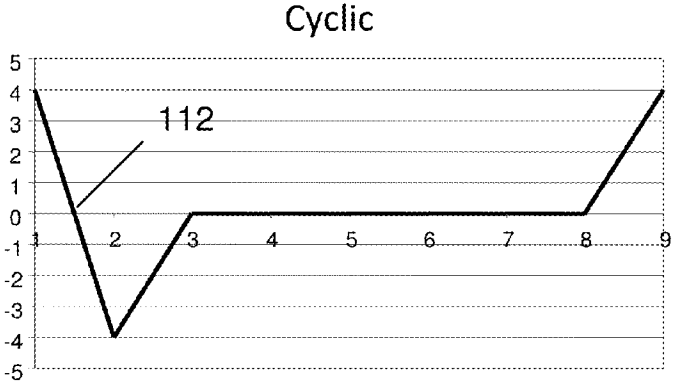
Fig. 2c
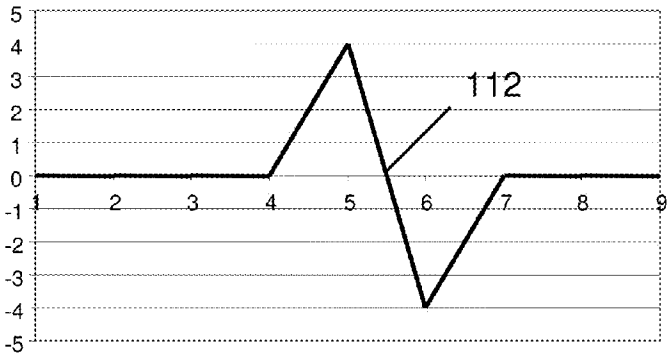
Fig. 2d
| Zero Interleaved | | | | | | | | |
|---|---|---|---|---|---|---|---|---|
| 1 | 0 | 1 | 0 | -1 | 0 | 1 | 1 | 0 |
| 1 | -1 | 1 | -1 | -1 | 1 | 1 | 1 | -1 |
202
204
+, - Symbol
Fig. 2a
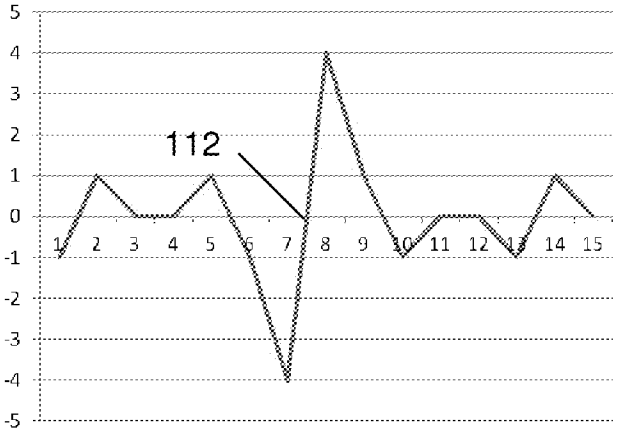
Fig. 2b

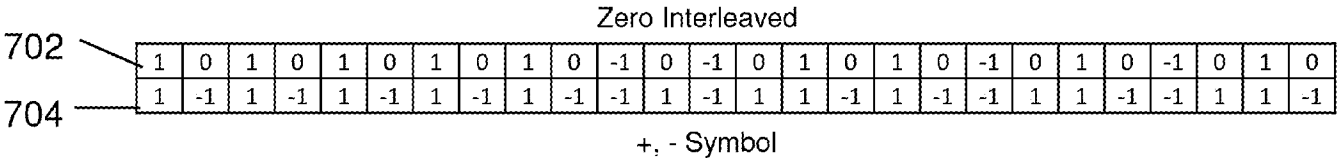
Fig. 7a
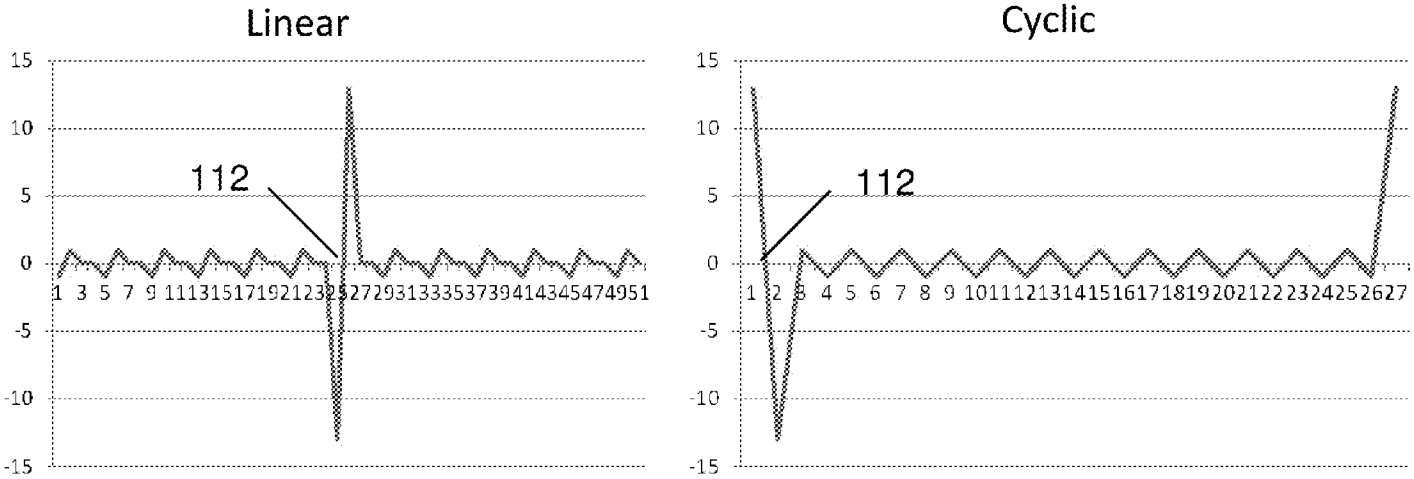
Fig. 7b
Fig. 7c

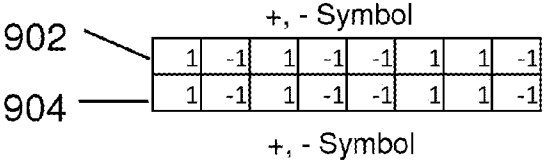
Fig. 9a
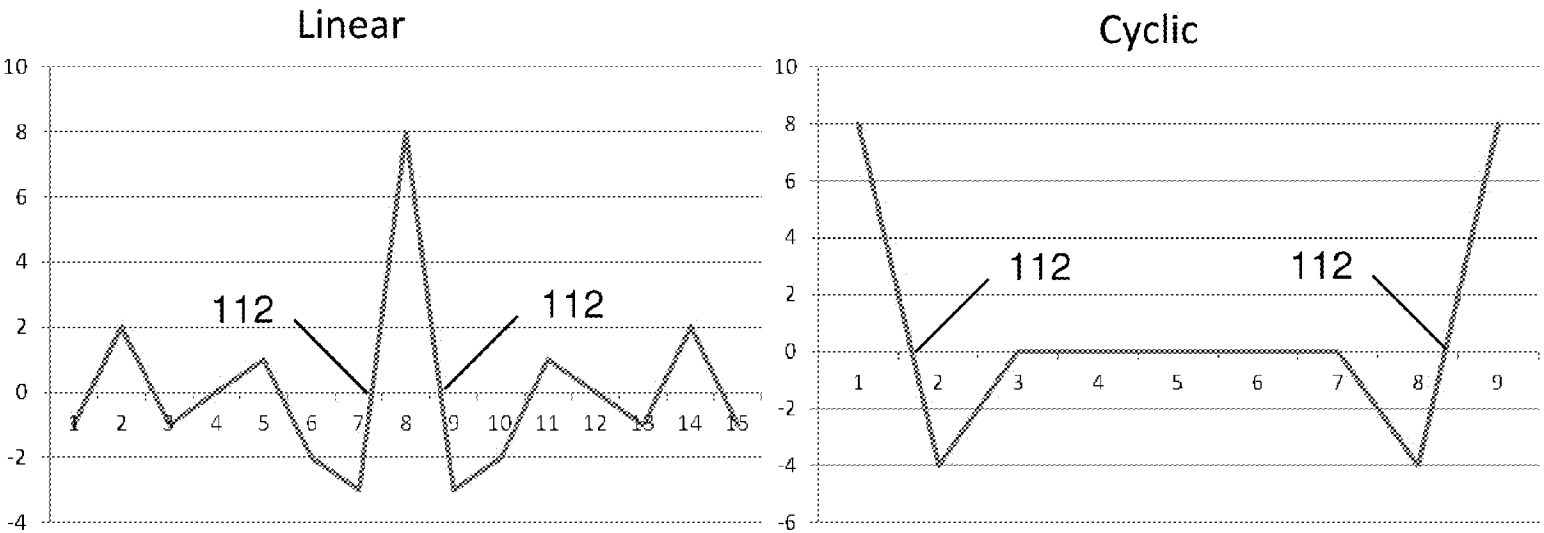
Fig. 9b
Fig. 9c

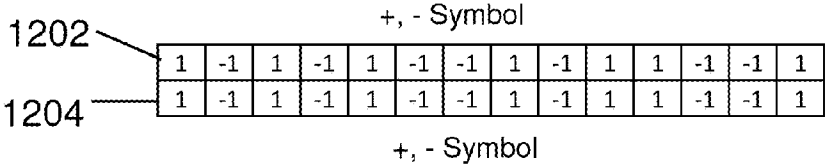
Fig. 12a
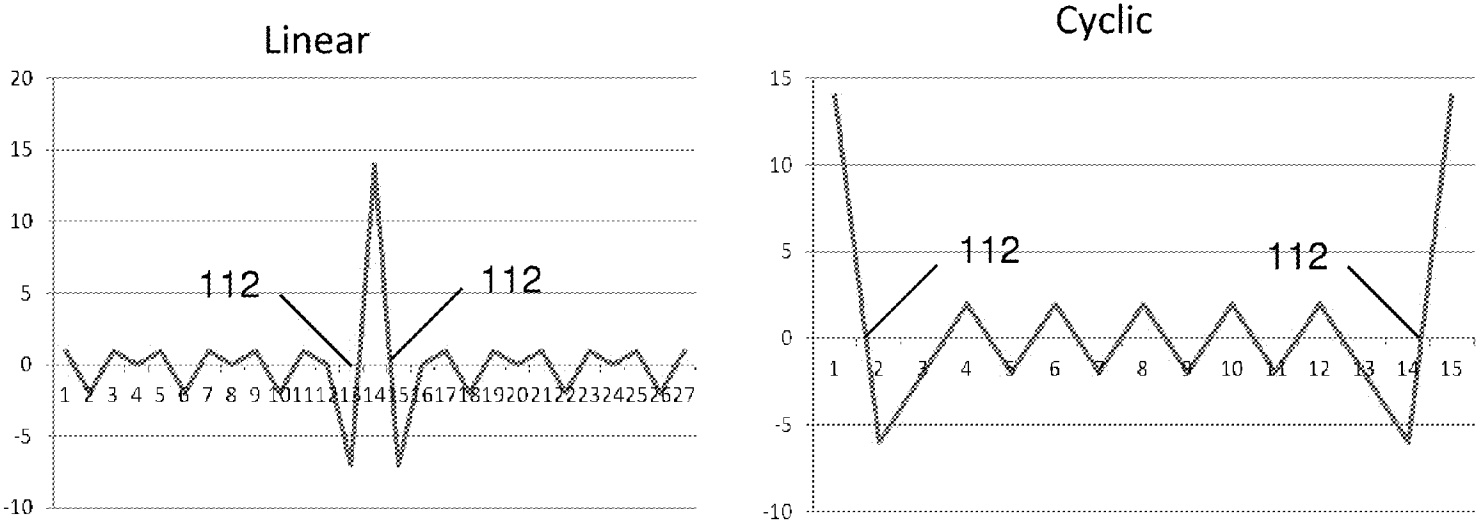
Fig. 12b
Fig. 12c

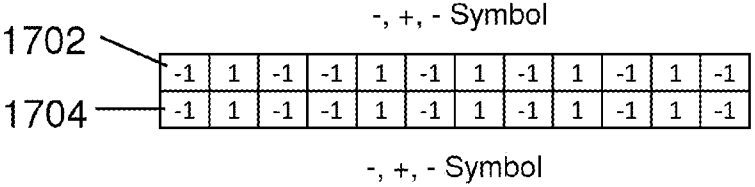
Fig. 17a
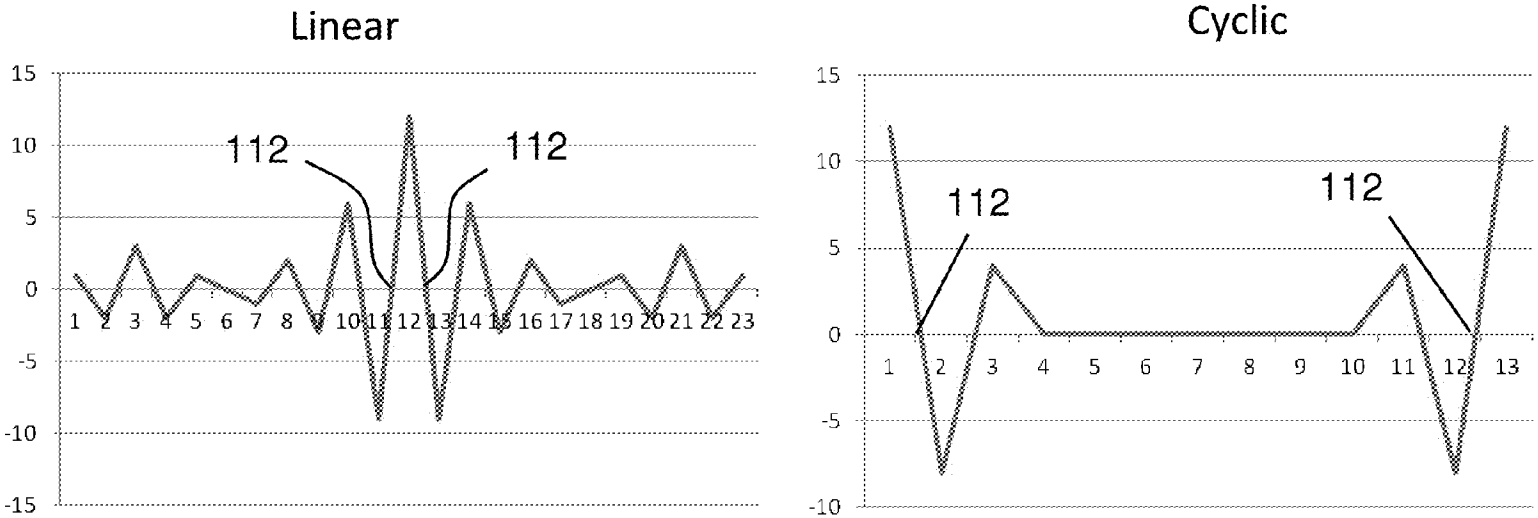
Fig. 17b
Fig. 17c

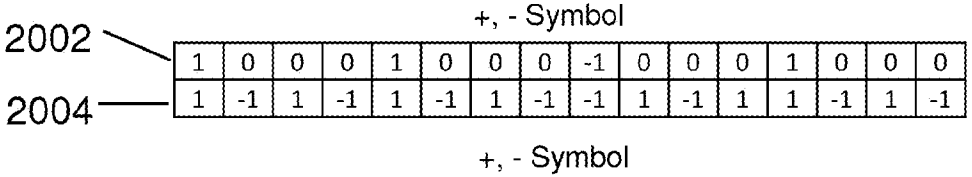
Fig. 20a
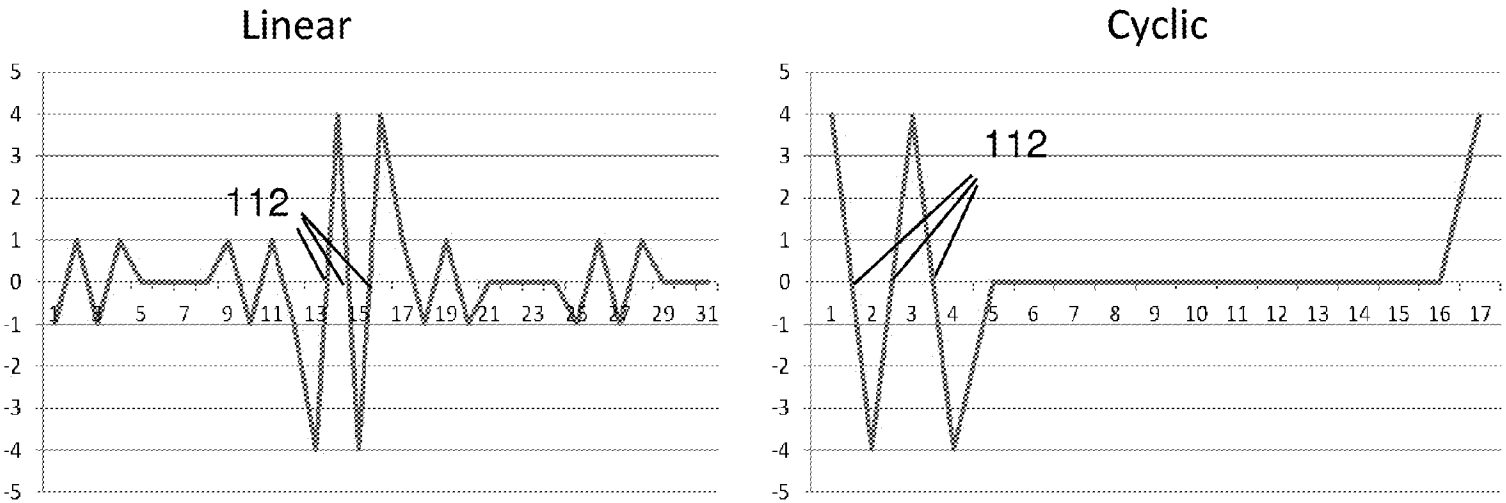
Fig. 20b
Fig. 20c

Cyclic

Linear

| | | | | | | | | | | | | | | | |
|---|---|---|---|---|---|---|---|---|---|---|---|---|---|---|---|
| 1 | -1 | 1 | -1 | 1 | -1 | 1 | -1 | 1 | -1 | 1 | -1 | 1 | -1 | 1 | -1 |
| 1 | -1 | -1 | 1 | 1 | -1 | -1 | 1 | -1 | 1 | 1 | -1 | -1 | 1 | -1 | 1 |
2502
2504
Fig. 25a
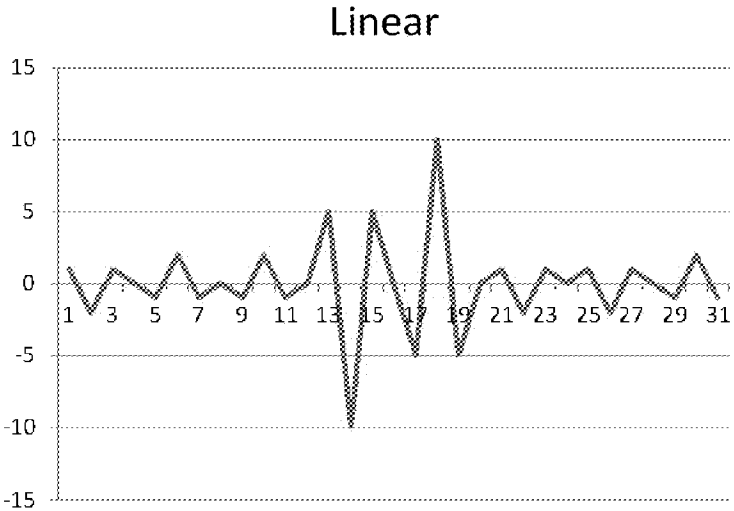
Fig. 25b
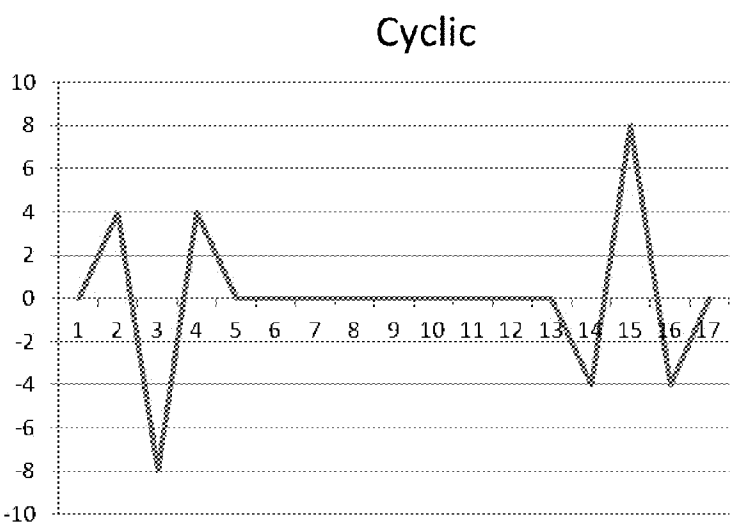
Fig. 25c

SYSTEM AND METHOD FOR POSITIONING A MULTI-POLE MAGNETIC STRUCTURE

RELATED APPLICATIONS

This application is a continuation in part of non-provisional application Ser. No. 14/035,818, titled "Magnetic Structures and Methods for Defining Magnetic Structures Using One-Dimensional Codes" filed Sep. 24, 2013 by Fullerton et al. and claims the benefit under 35 USC 119(e) of provisional application 61/796,863, titled "System for Determining a Position of a Multi-pole Magnetic Structure", filed Nov. 21, 2012 by Roberts; Ser. No. 14/035,818 is a continuation in part of non-provisional application Ser. No. 13/959,649, titled "Magnetic Device Using Non Polarized Magnetic Attraction Elements" filed Aug. 5, 2013 by Richards et al. and claims the benefit under 35 USC 119(e) of provisional application 61/744,342, titled "Magnetic Structures and Methods for Defining Magnetic Structures Using One-Dimensional Codes", filed Sep. 24, 2012 by Roberts; Ser. No. 13/959,649 is a continuation in part of non-provisional application Ser. No. 13/759,695, titled: "System and Method for Defining Magnetic Structures" filed Feb. 5, 2013 by Fullerton et al., which is a continuation of application Ser. No. 13/481,554, titled: "System and Method for Defining Magnetic Structures", filed May 25, 2012, by Fullerton et al., U.S. Pat. No. 8,368,495; which is a continuation-in-part of Non-provisional application Ser. No. 13/351,203, titled "A Key System For Enabling Operation Of A Device", filed Jan. 16, 2012, by Fullerton et al., U.S. Pat. No. 8,314,671; Ser. No. 13/481,554 also claims the benefit under 35 USC 119(e) of provisional application 61/519,664, titled "System and Method for Defining Magnetic Structures", filed May 25, 2011 by Roberts et al.; Ser. No. 13/351,203 is a continuation of application Ser. No. 13,157,975, titled "Magnetic Attachment System With Low Cross Correlation", filed Jun. 10, 2011, by Fullerton et al., U.S. Pat. No. 8,098,122, which is a continuation of application Ser. No. 12/952,391, titled: "Magnetic Attachment System", filed Nov. 23, 2010 by Fullerton et al., U.S. Pat. No. 7,961,069; which is a continuation of application Ser. No. 12/478,911, titled "Magnetically Attachable and Detachable Panel System" filed Jun. 5, 2009 by Fullerton et al., U.S. Pat. No. 7,843,295; Ser. No. 12/952,391 is also a continuation of application Ser. No. 12/478,950, titled "Magnetically Attachable and Detachable Panel Method," filed Jun. 5, 2009 by Fullerton et al., U.S. Pat. No. 7,843,296; Ser. No. 12/952,391 is also a continuation of application Ser. No. 12/478,969, titled "Coded Magnet Structures for Selective Association of Articles," filed Jun. 5, 2009 by Fullerton et al., U.S. Pat. No. 7,843,297; Ser. No. 12/952,391 is also a continuation of application Ser. No. 12/479,013, titled "Magnetic Force Profile System Using Coded Magnet Structures," filed Jun. 5, 2009 by Fullerton et al., U.S. Pat. No. 7,839,247; the preceding four applications above are each a continuation-in-part of Non-provisional application Ser. No. 12/476,952 filed Jun. 2, 2009, by Fullerton et al., titled "A Field Emission System and Method", which is a continuation-in-part of Non-provisional application Ser. No. 12/322,561, filed Feb. 4, 2009 by Fullerton et al., titled "System and Method for Producing an Electric Pulse".

All of the above referenced applications and patent documents are hereby incorporated herein by reference in their entirety.

TECHNICAL FIELD

The present invention relates generally to the field of determining a position and/or controlling the position of a multi-pole magnetic structure. More particularly, the present invention relates to the field of determining a position of a multi-pole magnetic structure having magnetic sources arranged in accordance with a code derived from a base code and a symbol. Embodiments may use a plurality of sensors arranged in accordance with the code.

BACKGROUND

Brief Description

The present disclosure relates generally to systems and methods for arranging magnetic sources for producing field patterns having high gradients for precision positioning, position sensing, and pulse generation. Magnetic fields may be arranged in accordance with codes having a maximum positive cross correlation and a maximum negative cross correlation value in proximity in the correlation function, thereby producing a high gradient slope corresponding to a high gradient force or signal associated with the magnetic structure. Various codes for doublet, triplet, and quad peak patterns are disclosed. Applications include force and torque pattern generators. A variation including magnetic sensors is disclosed for precision position sensing. The forces or sensor outputs may have a precision zero crossing between two adjacent and opposite maximum correlation peaks.

A class of codes may be derived from known codes having autocorrelation properties with a high peak and low side lobes. Examples of such root or source codes include, but are not limited to Barker codes, Pseudo Noise (PN) codes, Linear Feedback Shift Register (LFSR) codes, maximal length LFSR codes, Kassami codes, Golomb ruler codes, Costas arrays, and other codes.

One class of codes may be derived by generating a pair of codes. The first code may be generated by adding a zero after each code element, stated alternatively, by replacing each code element by an $(a_i, 0)$ symbol, where $a_i$ is the source code element. (A symbol is a sequence of code elements.) The second code may be generated by replacing each source code element with a (1,−1) symbol or (−1, 1) symbol according to the polarity of the source code, i.e., each source code element is replaced by the symbol $(a_i, -a_i)$, where $a_i$ is each source code element.

A second class of codes may be generated by generating a pair of codes. Both the first and second code generated by replacing the source code elements with $(a_i, -a_i)$ symbols.

A third class of code pairs may be generated by generating a first code by replacing the source code elements with $(a_{i,0,0})$ and generating a second code by replacing source code elements with $(a_i, a_i, a_i)$.

Another class of code pairs may be generated by generating a first code and a second code by replacing the source code elements with $(a_i, -a_i, a_i)$.

Another class of code pairs may be generated by generating a first code by replacing the source code elements with $(a_i, 0, 0, 0)$ and generating a second code by replacing source code elements with $(a_i, -a_i, a_i, -a_{ii})$.

A magnetic force pattern or sensing pattern of length k may be generated by starting with a source code having desirable impulse autocorrelation and generating a code pair, the first code of the code pair generated by replacing the source code elements with the pattern multiplied by the respective source code element, $(a_iP_1, a_iP_2, a_iP_3, a_iP_k)$, where $a_i$, is each source code element and $P_1, \ldots, P_k$ is the pattern sequence of length k. An equivalent formulation is where the source code elements are replaced by a sequence that is a product of the source code element and a pattern sequence: $a_i$ ($P_1$, $P_2$, $P_3$, . . . , $P_k$).

In a further variation, a compound pattern may be generated by replacing the elements of a first pattern with the elements of a second pattern in accordance with the elements of the first pattern, i.e., with respect to the polarity of the elements of the first pattern. For example, the elements of the first pattern, $P1_k$, may be multiplied by the elements of a second pattern, $P2_j$, to produce a compound pattern, ($P1_kP2_j$). The compound pattern is then used to produce the first code and/or the second code using the elements of the source code, $a_i$, ($a_iP1_kP2_j$).

In a further variation, a resulting code length may be increased by one or more positions by adding additional zero or one values.

The codes and magnetic structures may be configured in a linear (non-cyclic) or cyclic configuration. The linear (also referred to as non-cyclic) configuration is characterized by both codes operating as a single code modulo, i.e., with zeroes before and after the codes so that as one code slides by the other to form the correlation, elements that are past the end of the other code match with a zero resulting in a zero product. Cyclic codes in contrast are configured with at least one of the codes appearing in multiple modulos or cycles, or configured in a circle to wrap on itself such that elements of the second code past the end of one code modulo of the first code interact with elements of another code modulo of the first code, yielding a possible non-zero correlation result.

A motor or stepping motor may be produced in accordance with this disclosure by producing a rotor in accordance with one of the codes of a code pair and programming electromagnet fields corresponding to the other code of the code pair. A stepping motor with a doublet pattern will have a single strong holding position at the maximum attraction peak. The adjacent maximum repelling peak will present a high torque barrier to deviation in that direction. Conversely, stepping in the opposite direction can provide double torque and acceleration.

A triplet pattern will have a strong holding point at the maximum peak flanked by adjacent high torque repelling peaks to maintain precision holding, even under load.

A device with a magnetic force function over a range of motion may be produced by arranging a first magnetic assembly of elements according to the first code of a code pair as previously described and arranging a second magnetic assembly of magnetic elements according to the second code. The magnetic assemblies may be configured to operate opposite one another across an interface boundary in accordance with the cross correlation of the two codes.

A device for sensing position may be produced by arranging a first magnetic assembly of magnetic elements in accordance with the second code and arranging a group of magnetic sensors in accordance with the first code. The magnetic assembly may be placed on an object to be measured and the magnetic sensors may be placed on a reference frame. Motion between the magnetic assembly and the reference frame would trace a pattern related to the cross correlation function of the two codes. In particular, a position between a maximum positive and maximum negative correlation position could be very precisely located because of the high sensing gradient between the two maximum correlation positions.

A device for producing an electrical pulse may be produced by arranging a first magnetic assembly in accordance with the second code and arranging magnetic sensing coils in accordance with the first code. The magnetic assembly may be placed on a moving element and the coils placed on a fixed assembly. As the magnetic assembly passes by the coil assembly, the output voltage may be in accordance with the gradient of the cross correlation function. Thus, a point between a maximum positive and adjacent maximum negative cross correlation peak would produce the highest voltage output, having the highest magnetic gradient along the path.

These and further benefits and features of the present invention are herein described in detail with reference to exemplary embodiments in accordance with the invention.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

FIG. 2*a*-FIG. 2*d* depict an exemplary code pair based on a first Barker length 4 code (1, 1, −1, 1).

FIG. 7*a*-FIG. 7*c* depict an exemplary code pair based on a Barker length 13 code (1, 1, 1, 1, 1, −1, −1, 1, 1, −1, 1, −1, 1).

FIG. 9*a*-FIG. 9*c* depict an exemplary code pair based on a Barker 4a code.

FIG. 12*a*-FIG. 12*c* depict an exemplary code pair based on a Barker 7 code.

FIG. 17*a*-FIG. 17*c* depict an exemplary asymmetrical triplet code pair based on a Barker 4a code.

FIG. 20*a*-FIG. 20*c* depict an exemplary symmetrical four peak code pair based on a Barker 4a code.

FIG. 25*a*-FIG. 25*c* depict the two codes of FIG. 24*a* where each '+' symbol has been replaced by a '+−' symbol and each '−' symbol has been replaced by a '−+' symbol, and corresponding correlation functions for linear and cyclic implementations.

DETAILED DESCRIPTION

Figure 1B:
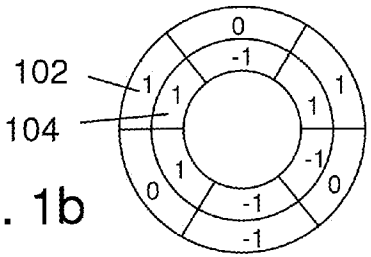
FIG. 1*a*-FIG. 1*e* depict an exemplary code pair having desirable adjacent position cross correlation transitions in accordance with the present disclosure.

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

Certain described embodiments may relate, by way of example but not limitation, to systems and/or apparatuses comprising magnetic structures, magnetic and non-magnetic materials, methods for using magnetic structures, magnetic structures produced via magnetic printing, magnetic structures comprising arrays of discrete magnetic elements, combinations thereof, and so forth. Example realizations for such embodiments may be facilitated, at least in part, by the use of an emerging, revolutionary technology that may be termed correlated magnetics. This revolutionary technology referred to herein as correlated magnetics was first fully described and enabled in the co-assigned U.S. Pat. No. 7,800,471 issued on Sep. 21, 2010, and entitled "A Field Emission System and Method". The contents of this document are hereby incorporated herein by reference. A second generation of a correlated magnetic technology is described and enabled in the co-assigned U.S. Pat. No. 7,868,721 issued on Jan. 11, 2011, and entitled "A Field Emission System and Method". The contents of this document are hereby incorporated herein by reference. A third generation of a correlated magnetic technology is described and enabled in the co-assigned U.S. patent application Ser. No. 12/476,952 filed on Jun. 2, 2009, and entitled "A Field Emission System and Method". The contents of this document are hereby incorporated herein by reference. Another technology known as correlated inductance, which is related to correlated magnetics, has been described and enabled in the co-assigned U.S. Pat. No. 8,115,581 issued on Feb. 14, 2012, and entitled "A System and Method for Producing an Electric Pulse". The contents of this document are hereby incorporated by reference.

Material presented herein may relate to and/or be implemented in conjunction with multilevel correlated magnetic systems and methods for producing a multilevel correlated magnetic system such as described in U.S. Pat. No. 7,982,568 issued Jul. 19, 2011 which is all incorporated herein by reference in its entirety. Material presented herein may relate to and/or be implemented in conjunction with energy generation systems and methods such as described in U.S. patent application Ser. No. 13/184,543 filed Jul. 17, 2011, which is all incorporated herein by reference in its entirety. Such systems and methods described in U.S. Pat. No. 7,681,256 issued Mar. 23, 2010, U.S. Pat. No. 7,750,781 issued Jul. 6, 2010, U.S. Pat. No. 7,755,462 issued Jul. 13, 2010, U.S. Pat. No. 7,812,698 issued Oct. 12, 2010, U.S. Pat. Nos. 7,817,002, 7,817,003, 7,817,004, 7,817,005, and 7,817,006 issued Oct. 19, 2010, U.S. Pat. No. 7,821,367 issued Oct. 26, 2010, U.S. Pat. Nos. 7,823,300 and 7,824,083 issued Nov. 2, 2011, U.S. Pat. No. 7,834,729 issued Nov. 16, 2011, U.S. Pat. No. 7,839,247 issued Nov. 23, 2010, U.S. Pat. Nos. 7,843,295, 7,843,296, and 7,843,297 issued Nov. 30, 2010, U.S. Pat. No. 7,893,803 issued Feb. 22, 2011, U.S. Pat. Nos. 7,956,711 and 7,956,712 issued Jun. 7, 2011, U.S. Pat. Nos. 7,958,575, 7,961,068 and 7,961,069 issued Jun. 14, 2011, U.S. Pat. No. 7,963,818 issued Jun. 21, 2011, and U.S. Pat. Nos. 8,015,752 and 8,016,330 issued Sep. 13, 2011, and U.S. Pat. No. 8,035,260 issued Oct. 11, 2011 are all incorporated by reference herein in their entirety.

The material presented herein may relate to and/or be implemented in conjunction with use of symbols within code such as is disclosed in U.S. Non-provisional patent application Ser. No. 13/895,589, filed Sep. 30, 2010, titled "System and Method for Energy Generation", which is incorporated herein by reference.

One variation of present disclosure pertains to a multi-pole magnetic structure having magnetic sources having polarities in accordance with a code and a sensor array for determining the position of the magnetic structure relative to the sensor array. The sensor array may be, for example, a Hall Effect sensor array that measures the magnetic field being produced by the magnetic structure, where the data from the Hall Effect sensors is processed in accordance with the polarity pattern of the code. The sensor array may alternatively be a ferromagnetic material, for example a magnet, another multi-pole magnetic structure such as a complementary magnetic structure or anti-complementary magnetic structure, or a piece of iron, where the ferromagnetic material is attached to a load cell that measures a force produced by the interaction of the magnetic structure and the ferromagnetic material. The sensor array may be coils wired in accordance with the code such as described in U.S. Pat. No. 8,115,581 referenced previously.

A multi-pole magnetic structure can be a plurality of discrete magnets or may be a single piece of magnetizable material having been printed with a pattern of magnetic sources, which may be referred to herein as maxels.

Exemplary Codes And Correlation Graphs

Various exemplary codes are now provided and described in detail with reference to the drawings. Many of the comments and observations noted with respect to one code example may be applicable to other examples or other codes in general.

Doublet Field Functions

Figure 1C:
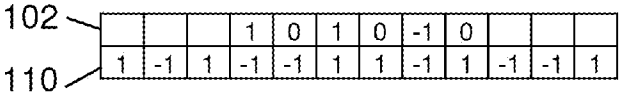
Figure 1A:
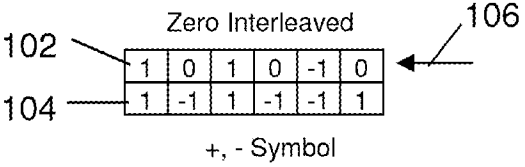
Figure 1E:
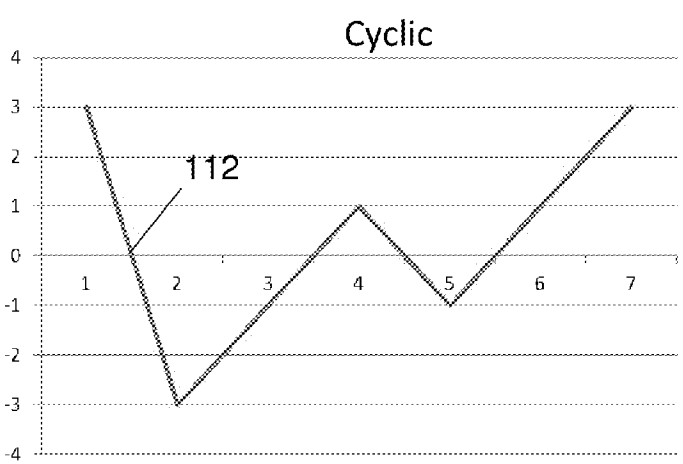

FIG. 1*a*-FIG. 1*e* depict an exemplary code pair having desirable adjacent position cross correlation transitions in accordance with the present disclosure. The exemplary code pair is derived from a root Barker length three code (1,1,−1). A first code of the pair may be referred to as a zero interleaved code, and may be derived by interleaving zeroes between Barker code elements, i.e., (1,0,1,0,−1,0). (As used herein a 1 may correspond to a magnet having a first polarity and a −1 may correspond to a magnet having an opposite polarity. A zero may represent a non-magnetic position, i.e., producing no attraction or repelling force with respect to a nearby magnet. 1 and −1 may be alternatively referred to as + and − respectively.) A second code may be referred to as a 1, −1 symbol code, and may be derived by substituting a symbol pair for each Barker element. (1,−1) is substituted for 1 and (−1,1) is substituted for −1, thus the resulting code is (1,−1, 1,−1,−1,1). The two codes may be operated in a linear configuration or a cyclic configuration. FIG. 1*a* shows the two codes in a linear configuration and aligned in a center alignment position. The top code 102 and bottom code 104 may slide left or right relative to one another to form the cross correlation. As shown, the top code 102 slides left according to arrow 106 to generate the correlation graph shown in FIG. 1*d*. FIG. 1*b* and FIG. 1*c* show the two codes 102, 104 in a cyclic configuration. In FIG. 1*b*, the inner ring and outer ring may rotate relative to one another to form the cross correlation. Alternatively, the two rings may be the same diameter and disposed one on top of the other (not shown). Codes may also be configured for cyclic operation using a linear array by placing multiple codes in sequence, end to end as shown in FIG. 1*c*. In FIG. 1*c*, the bottom code 104 of FIG. 1*a* is duplicated and placed in consecutive sequence with the first instance of the code to generate a double length code 110. The top code 102 is shown shifted in the direction shown by arrow 108 to position 4, where the correlation value is 1 as shown in FIG. 1*e*.

Other code pairs may be derived using different root codes, such as different length Barker codes or shifted Barker codes or other codes, for example but not limited to PN codes, Kassami codes, Gold codes, LFSR codes, random or pseudorandom codes or other codes. Golomb ruler codes, Costas arrays, and Walsh codes may also be used as root codes in accordance with this disclosure.

Figure 1D:
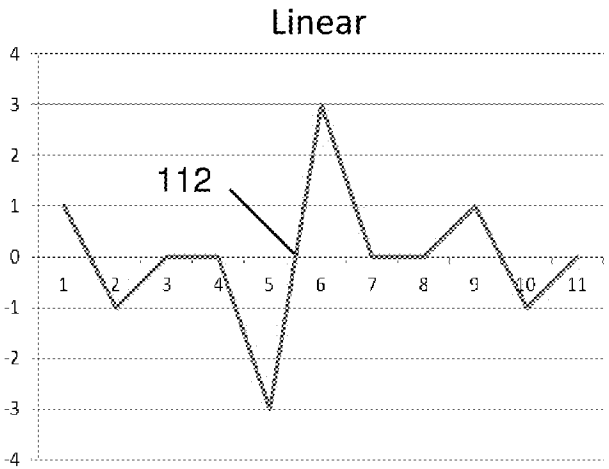

FIG. 1*d* and FIG. 1*e* depict two cross correlation functions of the configurations shown in FIG. 1*a* and FIG. 1*b* respectively. The linear implementation of FIG. 1*a* corresponds to a linear array of magnets and complementary magnets with no magnets beyond the end of the arrays, i.e. the codes are flanked by zeroes before and after the codes. If one or more copies of a top or bottom code is used, the spacing between the two instances is typically sufficient to avoid simultaneous interaction of both instances, i.e., a spacing of at least one code length. The linear configuration of FIG. 1*a* may also be referred to as a non-cyclic configuration. The cyclic implementation of FIG. 1*b* corresponds to a circular magnet structure with one or more code modulos arranged around the circle. FIG. 1*e* shows an alternative cyclic configuration.

The cross correlation function of FIG. 1*d* is formed by sliding the zero interleaved code 102 from right to left relative to the +− symbol code 104 of FIG. 1*a*. The position shown in FIG. 1*a* corresponds to position 6 in FIG. 1*c*. It can be seen that position 6 has a maximum value of +3 and position 5 has a value of −3, equal in magnitude and opposite in polarity to that of position 6 and adjacent to position 6. The two highest absolute value magnitudes +3 and −3 are in adjacent positions. The codes are calculated only at integral points. The calculated points are connected with straight lines roughly indicative of a magnetic field force function resulting from thin uniformly magnetized magnets arranged in accordance with the code. In practice, physical magnets have depth that may contribute to a rounding of the sharp peaks of the curves. Also, adjacent magnets and those nearby may have a slight effect on the value of a given location, not accounted for in the plots. FIG. 1*d* shows a zero crossing point 112 half way between position 5 and position 6. Point 112 is the highest slope zero crossing in the correlation function. It can be appreciated that in an analog system of real magnets, a zero crossing value would lie half way between the opposite maximum magnitude values. The transition between positions 5 and 6 would have the highest slope of any transition along the length of the code cross correlation.

FIG. 1*d* shows other zero crossings or zero values, for example from position 7 to position 8 and between position 9 and position 10, but the zero crossing 112 between 5 and 6 is the highest slope zero crossing flanked by the highest magnitude points 5 and 6 on the graph. The high slope of the 5-6 transition potentially translates to performance advantages in a number of magnetic systems. For example, a system configured for producing a force or torque would have a maximum force or torque at this zero crossing point, half way between maximum attraction and maximum repelling force, acted upon simultaneously by both maximum forces. Alternatively, a system configured for sensing position would sense a balance (zero crossing) between positions 5 and 6, but the slightest movement in either direction would result in a strong signal which may favorably overcome noise and system errors for more precision position sensing. In a further alternative, a system configured for inductive coupling to the magnets would see a high rate of change of field upon transitioning from position 5 to position 6 and thus produce a high voltage or current output at point 112, having the highest slope of all points on the graph.

FIG. 1*e* shows the cross correlation of the cyclic configuration of FIG. 1*b*. The position shown in FIG. 1*b* corresponds to position 1 of FIG. 1*e*. As the outer ring with the zero interleave code is rotated clockwise, the positions increment in the positive direction (to the right) in FIG. 1*e*. The maximum magnitude values of +3 and −3 occur at positions 1 and 2 respectively. Thus the maximum slope transition is between +3 and −3, positions 1 and 2, respectively. As discussed with respect to FIG. 1*a* and FIG. 1*d*, the maximum slope in FIG. 1*e* may result in the same performance advantages previously discussed. Typically, with cyclic codes, rotating one code pattern may rotate the correlation pattern. (See FIG. 2*d*.) Thus, the peak values, shown at the end of the correlation pattern may be moved to the center or another location by rotating one of the codes.

In accordance with the principles of this disclosure, it may be desirable to utilize the zero crossing of the steepest transition between a peak attract and peak repel. For clarity of discussion, attraction may be arbitrarily assigned positive polarity and repelling assigned negative polarity. For both correlation functions such zero crossings are identified between peak attract of 3 and peak repel of −3. For the linear function, off peak values of −1, 1, and 0 are present and in the cyclic function, off peak values of 1 and −1 are present. A typical code pair may offer a peak correlation equal to the length of the root code and differential equal to twice the root code with a maximum off peak magnitude of 1. Thus, for improved peak to off peak ratio, a longer code may be selected. Exemplary longer codes are shown in FIG. 2-FIG. 7. FIG. 2*a*-FIG. 2*d* depict an exemplary code pair based on a first Barker length 4 code (1, 1, −1, 1), designated Barker 4a herein. The two codes are derived as with the codes of FIG. 1*a* and FIG. 1*b*, the first code 202 interleaved with zeros and the second code 204 derived by substituting elements with 1, −1 and −1, 1 symbols. The corresponding cross correlation functions for linear and cyclic implementations are shown in FIG. 2*b* and FIG. 2*c* respectively. The cyclic geometry is not shown, but may be derived from FIG. 1*b* and FIG. 1*c* using the codes of FIG. 2*a*.

FIG. 2*d* shows the cyclic correlation function of FIG. 2*c* with the first code 202 rotated four positions. Note that the correlation patterns of the Barker cyclic codes may be rotated any amount by rotating one of the codes. Rotating a code, for example, code 202 means shifting the code to the right or left and then taking the last position and moving it to the first position. Rotate right one position for code 202 results in 0, 1, 0, 1, 0, −1, 0, 1.

Figure 3A:
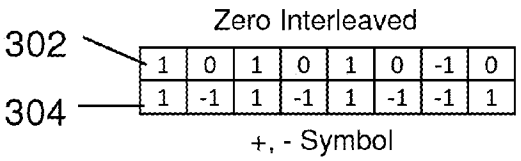
FIG. 3*a*-FIG. 3*c* depict an exemplary code pair based on a second Barker length 4 code (1, 1, 1, −1).
Figure 3B:
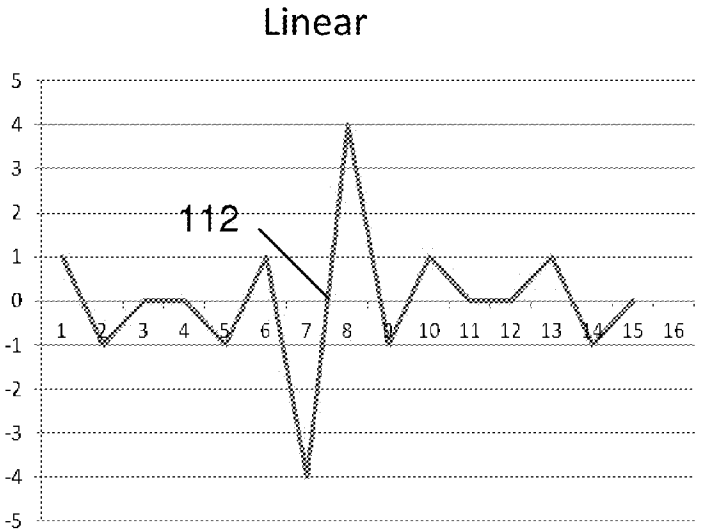
Figure 3C:
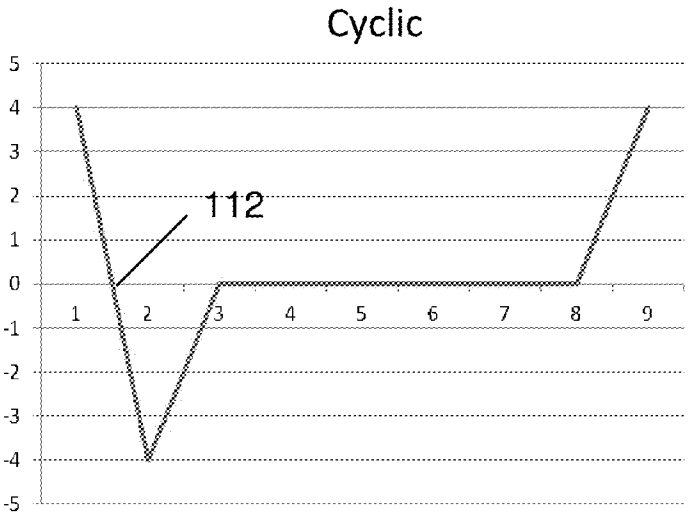

FIG. 3*a*-FIG. 3*c* depict an exemplary code pair based on a second Barker length 4 code (1, 1, 1, −1), designated Barker 4b herein. The two codes are derived as with the codes of FIG. 1*a* and FIG. 1*b*, the first code 302 interleaved with zeros and the second code 304 derived by substituting elements with 1, −1 and −1, 1 symbols. The corresponding cross correlation functions for linear and cyclic implementations are shown in FIG. 3*b* and FIG. 3*c* respectively.

Figure 4A:
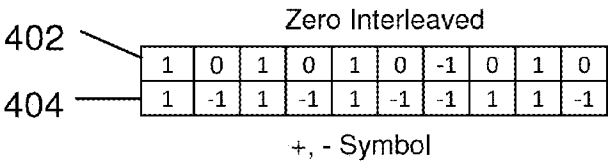
FIG. 4*a*-FIG. 4*c* depict an exemplary code pair based on a Barker length 5 code (1, 1, 1, −1, 1).
Figure 4C:
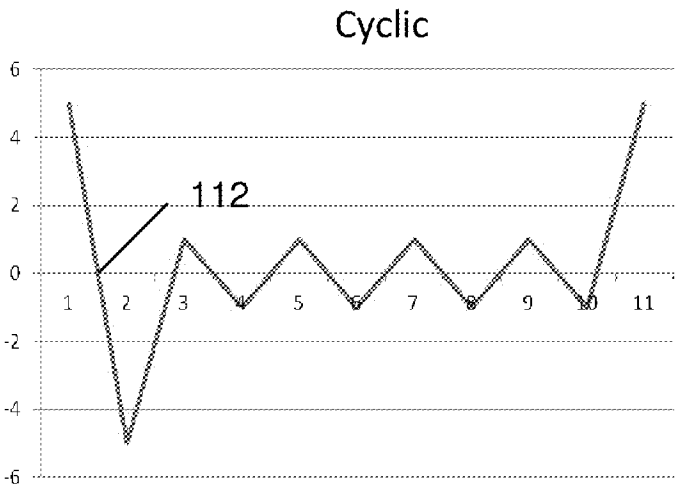
Figure 4B:
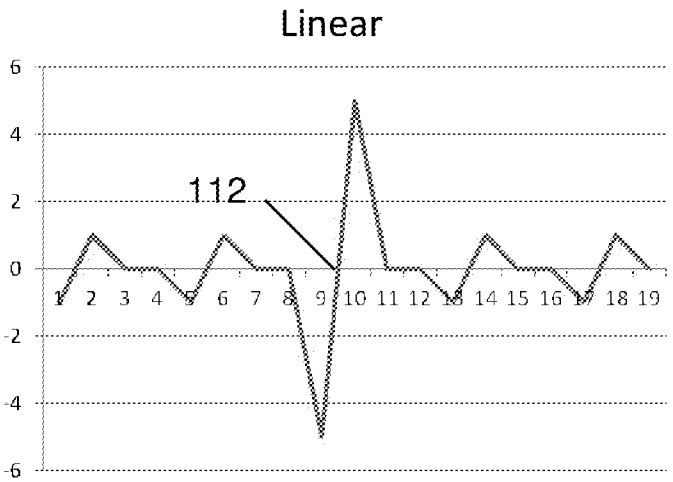

FIG. 4*a*-FIG. 4*c* depict an exemplary code pair based on a Barker length 5 code (1, 1, 1, −1, 1), designated Barker 5 herein. The two codes are derived as with the codes of FIG. 1*a* and FIG. 1*b*, the first code 402 interleaved with zeros and the second code 404 derived by substituting elements with 1, −1 and −1, 1 symbols. The corresponding cross correlation functions for linear and cyclic implementations are shown in FIG. 4*b* and FIG. 4*c* respectively.

Figure 5A:
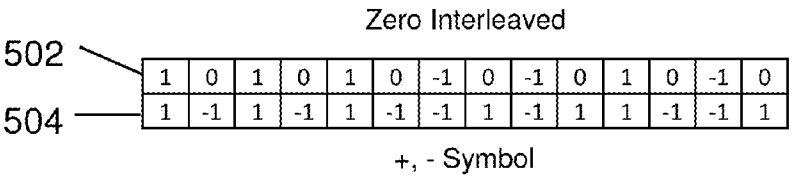
FIG. 5*a*-FIG. 5*c* depict an exemplary code pair based on a Barker length 7 code (1, 1, 1, −1, −1, 1, −1).
Figure 5B:
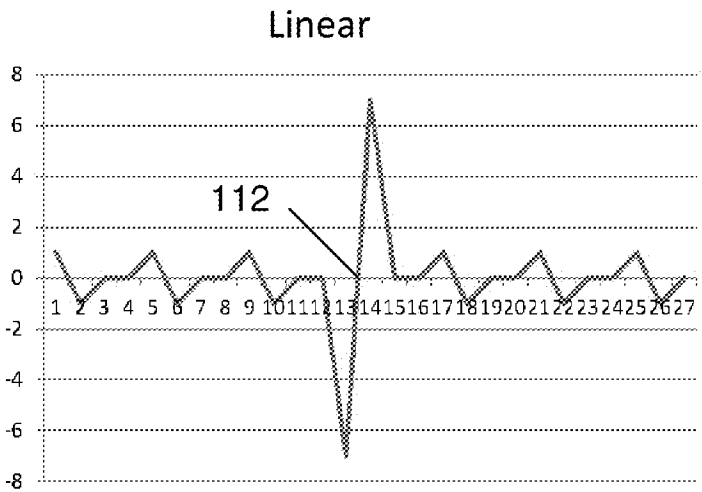
Figure 5C:
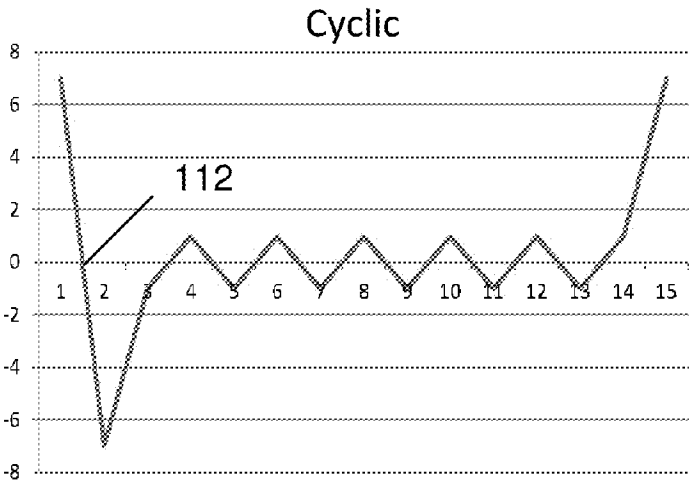

FIG. 5*a*-FIG. 5*c* depict an exemplary code pair based on a Barker length 7 code (1, 1, 1, −1, −1, 1, −1), designated Barker 7 herein. The two codes are derived as with the codes of FIG. 1*a* and FIG. 1*b*, the first code 502 interleaved with zeros and the second code 504 derived by substituting elements with 1, −1 and −1, 1 symbols. The corresponding cross correlation functions for linear and cyclic implementations are shown in FIG. 5*b* and FIG. 5*c* respectively.

Figure 6A:
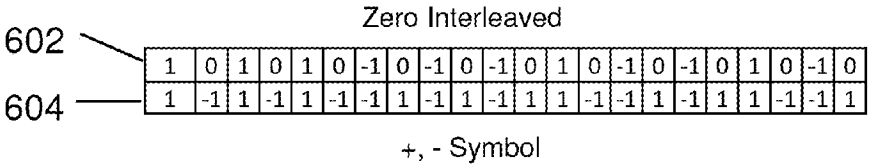
FIG. 6*a*-FIG. 6*c* depict an exemplary code pair based on a Barker length 11 code (1, 1, 1, −1, −1, −1, 1, −1, −1, 1, −1).
Figure 6B:
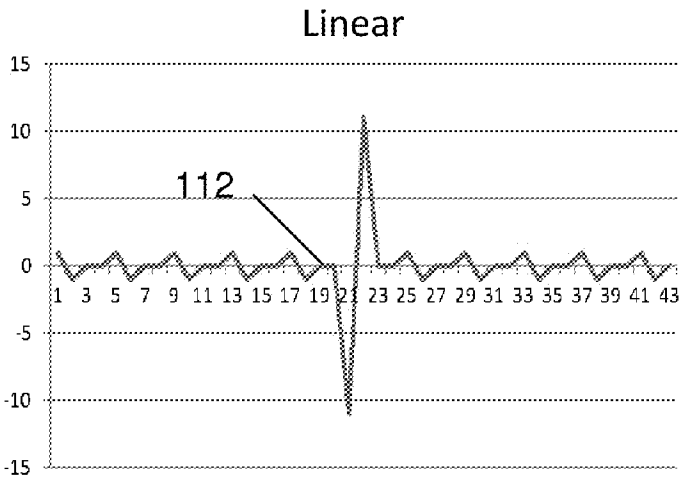
Figure 6C:
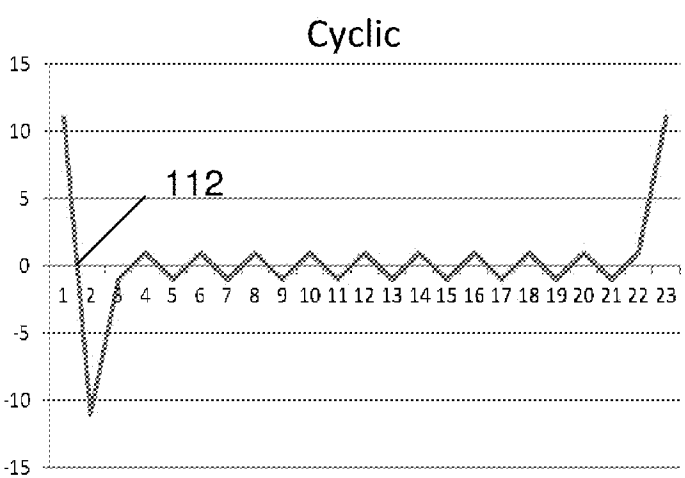

FIG. 6*a*-FIG. 6*c* depict an exemplary code pair based on a Barker length 11 code (1, 1, 1, −1, −1, −1, 1, −1, −1, 1, −1), designated Barker 11 herein. The two codes are derived as with the codes of FIG. 1*a* and FIG. 1*b*, the first code 602 interleaved with zeros and the second code 604 derived by substituting elements with 1, −1 and −1, 1 symbols. The corresponding cross correlation functions for linear and cyclic implementations are shown in FIG. 6*b* and FIG. 6*c* respectively.

FIG. 7*a*-FIG. 7*c* depict an exemplary code pair based on a Barker length 13 code (1, 1, 1, 1, 1, −1, −1, 1, 1, −1, 1, −1, 1), designated Barker 13 herein. The two codes are derived as with the codes of FIG. 1*a* and FIG. 1*b*, the first code 702 interleaved with zeros and the second code 704 derived by substituting elements with 1, −1 and −1, 1 symbols. The corresponding cross correlation functions for linear and cyclic implementations are shown in FIG. 7*b* and FIG. 7*c* respectively.

Triplet Patterns

In a further variation, codes may be generated that can produce triplet correlation patterns, i.e., patterns with a first maximum of a first polarity flanked by maxima of opposite polarity on either side adjacent to the first maximum. In a mechanical system, the triplet pattern represents a strong attraction at the first peak flanked by strong repelling forces on either side. This results in a precision holding point constrained by repelling forces that come into play for a slight deviation from the center. Thus the triplet code patterns may be used to arrange magnetic elements for precision attachment and holding applications. For magnetic position sensing applications, a sensor may be configured to sense each zero crossing and then connected for differential sensing. Thus error factors that affect both signals the same would be cancelled, resulting in a precision zero position.

Figure 8A:
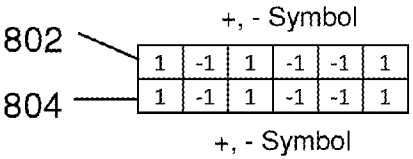
FIG. 8*a*-FIG. 8*c* depict an exemplary code pair based on a Barker 3 code.
Figure 8C:
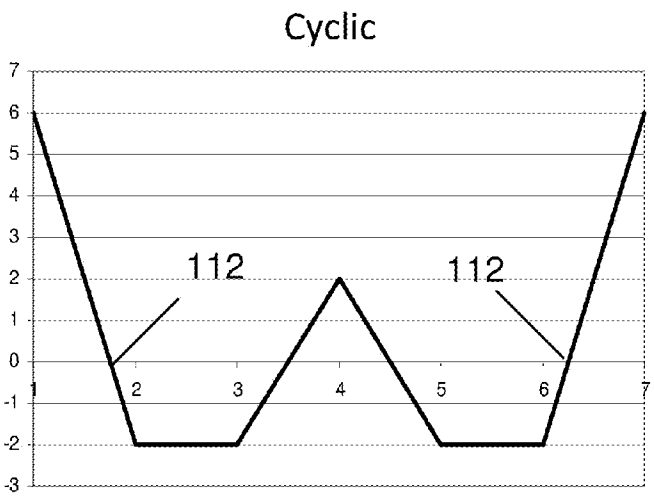
Figure 8B:
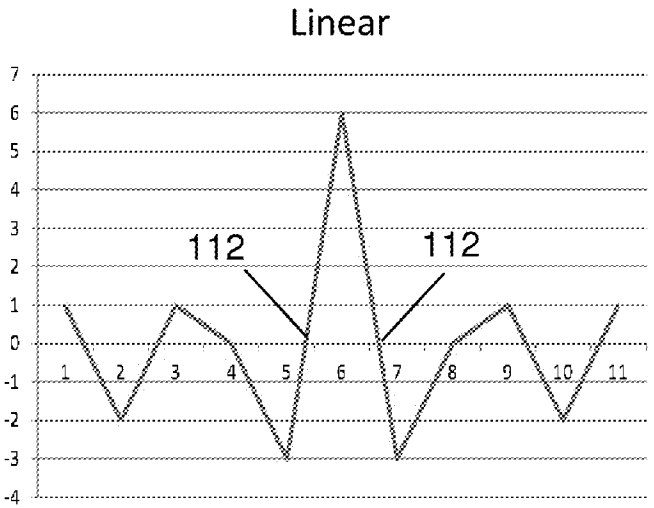

FIG. 8*a*-FIG. 8*c* depict an exemplary code pair based on a Barker 3 code. Each code of the pair 802, 804 is derived by substituting each Barker 3 element with a two element symbol, i.e., a 1 is substituted with a 1, −1 pair and a −1 is substituted with a −1, 1 pair. The corresponding cross correlation functions for linear and cyclic implementations are shown in FIG. 8*b* and FIG. 8*c* respectively. Note the linear code peak of 6 is equal to the code length and the negative peaks −3 are equal to half of the code length. The cyclic code peak is also equal to the code length.

FIG. 9*a*-FIG. 9*c* depict an exemplary code pair based on a Barker 4a code. Each code of the pair 902, 904 is derived by substituting each Barker 3 element with a two element symbol, i.e., a 1 is substituted with a 1, −1 pair and a −1 is substituted with a −1, 1 pair. The corresponding cross correlation functions for linear and cyclic implementations are shown in FIG. 9*b* and FIG. 9*c* respectively. Note the maximum peaks are equal to the code length, twice the root code length.

Figure 10A:
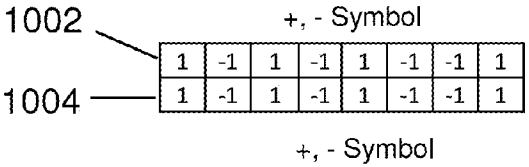
FIG. 10*a*-FIG. 10*c* depict an exemplary code pair based on a Barker 4b code.
Figure 10B:
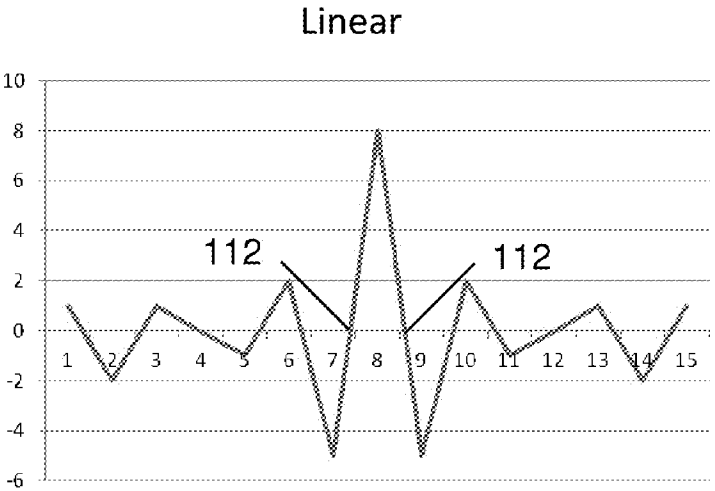
Figure 10C:
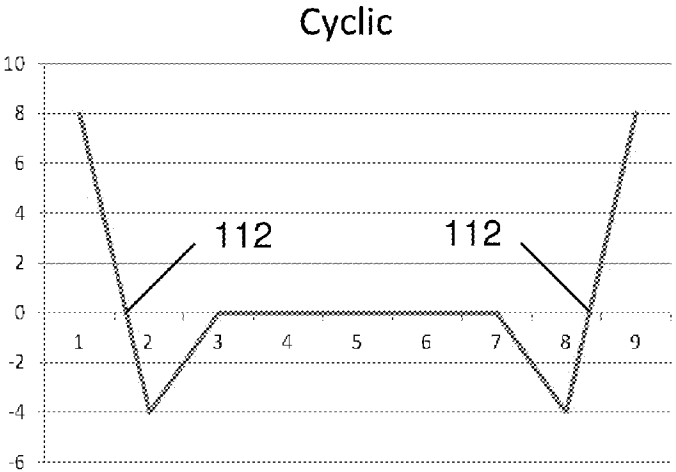

FIG. 10*a*-FIG. 10*c* depict an exemplary code pair based on a Barker 4b code. Each code of the pair 1002, 1004 is derived by substituting each Barker 3 element with a two element symbol, i.e., a 1 is substituted with a 1, −1 pair and a −1 is substituted with a −1, 1 pair. The corresponding cross correlation functions for linear and cyclic implementations are shown in FIG. 10*b* and FIG. 10*c* respectively.

Figure 11A:
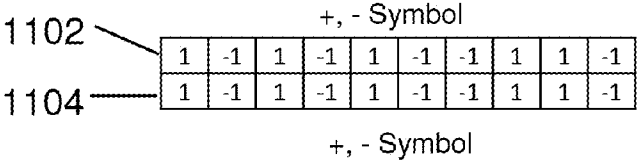
FIG. 11*a*-FIG. 11*c* depict an exemplary code pair based on a Barker 5 code.
Figure 11B:
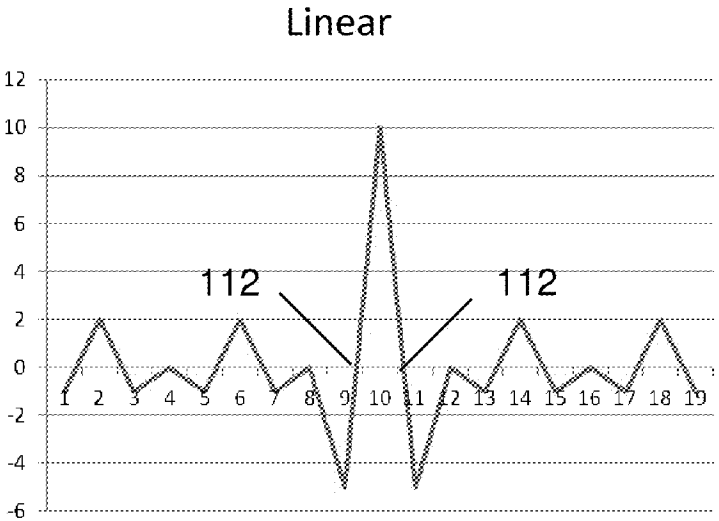
Figure 11C:
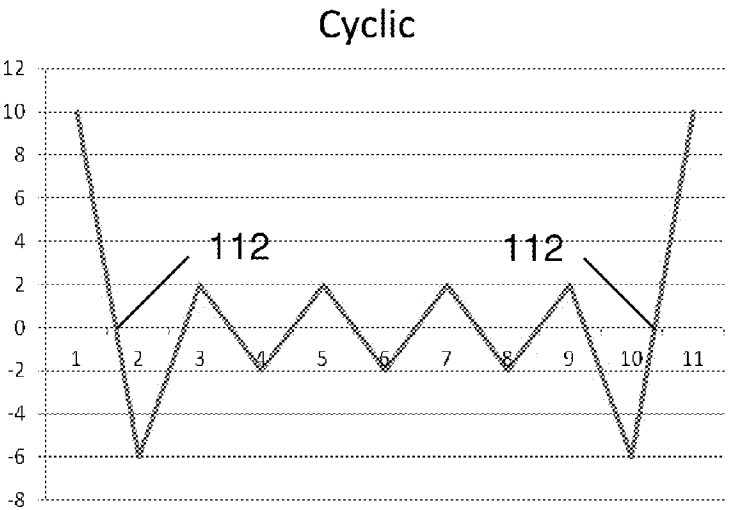

FIG. 11*a*-FIG. 11*c* depict an exemplary code pair based on a Barker 5 code. Each code of the pair 1102, 1104 is derived by substituting each Barker 3 element with a two element symbol, i.e., a 1 is substituted with a 1, −1 pair and a −1 is substituted with a −1, 1 pair. The corresponding cross correlation functions for linear and cyclic implementations are shown in FIG. 11*b* and FIG. 11*c* respectively.

FIG. 12*a*-FIG. 12*c* depict an exemplary code pair based on a Barker 7 code. Each code of the pair 1202, 1204 is derived by substituting each Barker 3 element with a two element symbol, i.e., a 1 is substituted with a 1, −1 pair and a −1 is substituted with a −1, 1 pair. The corresponding cross correlation functions for linear and cyclic implementations are shown in FIG. 12*b* and FIG. 12*c* respectively.

Figure 13A:
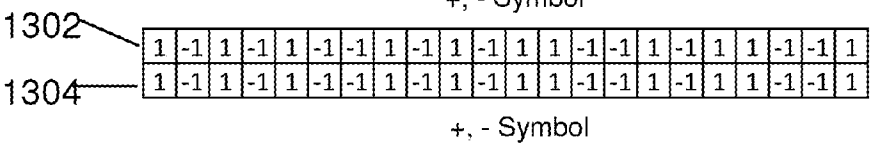
FIG. 13*a*-FIG. 13*c* depict an exemplary code pair based on a Barker 11 code.
Figure 13B:
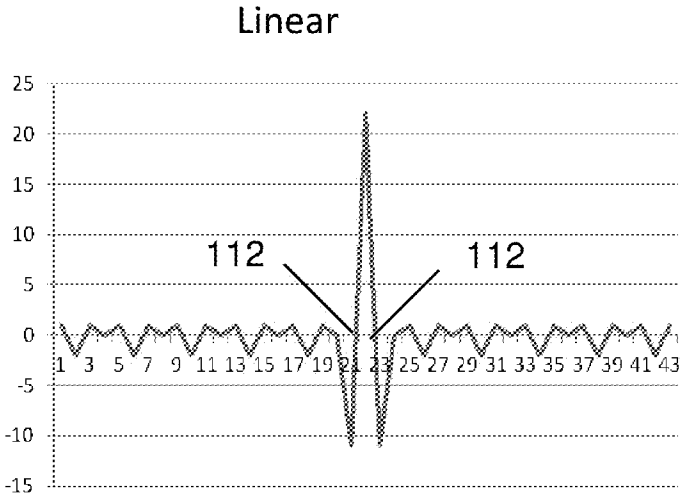
Figure 13C:
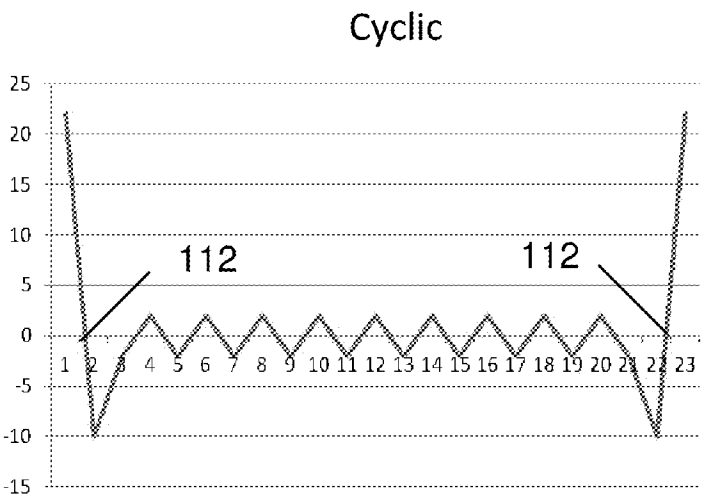

FIG. 13*a*-FIG. 13*c* depict an exemplary code pair based on a Barker 11 code. Each code of the pair 1302, 1304 is derived by substituting each Barker 3 element with a two element symbol, i.e., a 1 is substituted with a 1, −1 pair and a −1 is substituted with a −1, 1 pair. The corresponding cross correlation functions for linear and cyclic implementations are shown in FIG. 13*b* and FIG. 13*c* respectively.

Figure 14A:
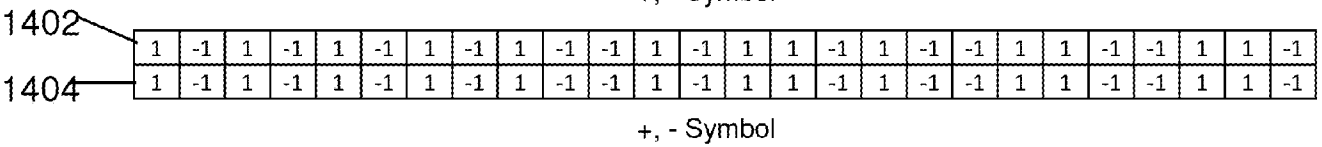
FIG. 14*a*-FIG. 14*c* depict an exemplary code pair based on a Barker 13 code.
Figure 14C:
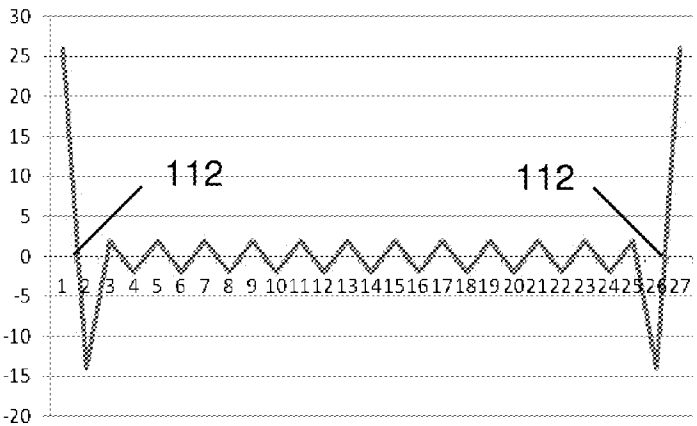
Figure 14B:
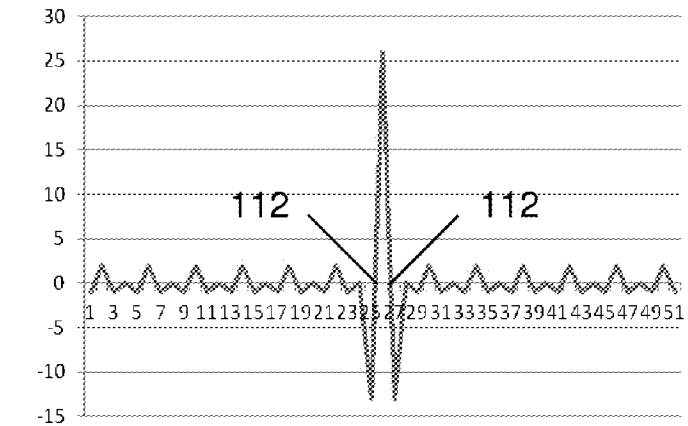

FIG. 14*a*-FIG. 14*c* depict an exemplary code pair based on a Barker 13 code. Each code of the pair 1402, 1404 is derived by substituting each Barker 3 element with a two element symbol, i.e., a 1 is substituted with a 1, −1 pair and a −1 is substituted with a −1, 1 pair. The corresponding cross correlation functions for linear and cyclic implementations are shown in FIG. 14*b* and FIG. 14*c* respectively.

Triplet and Higher Order Patterns with Three Element and Longer Symbols

In a further variation, a triplet pattern may be formed. The triplet pattern may be a symmetrical or asymmetrical pattern. A symmetrical triplet pattern may be formed wherein the peak positive and peak negative correlation values have the same magnitude. The peak magnitude may be equal to the root code length. Values off of the maximum peaks may have a maximum magnitude of 1.

Figure 15A:
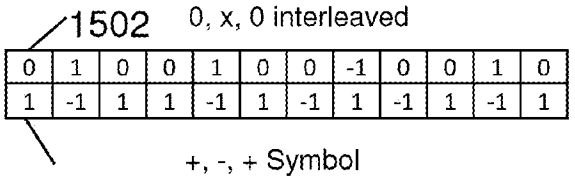
FIG. 15*a*-FIG. 15*d* depict an exemplary symmetrical triplet code pair based on a Barker 4a code.
Figure 15C:
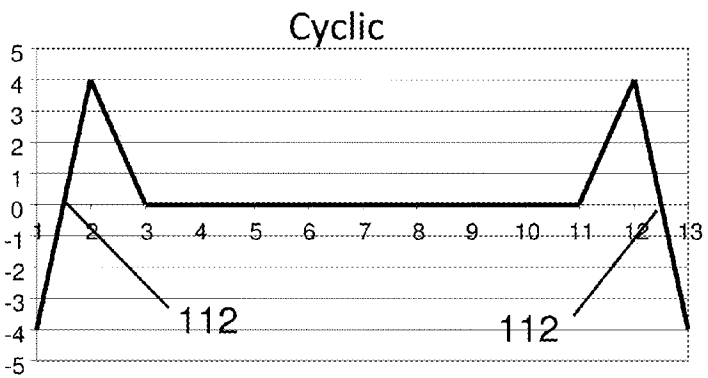
Figure 15B:
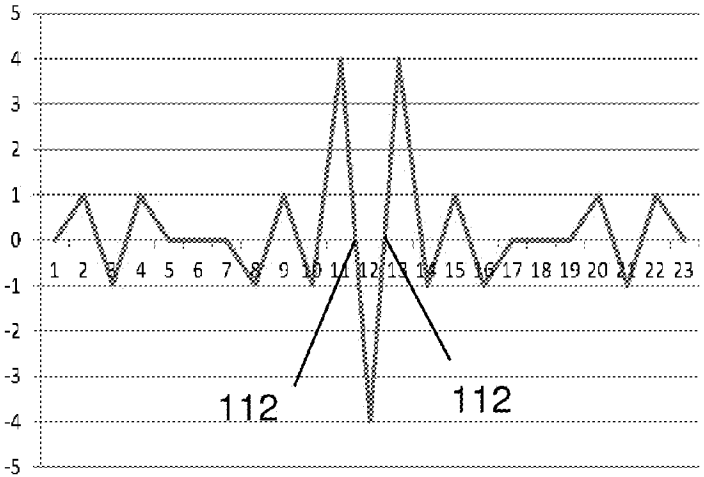
Figure 15D:
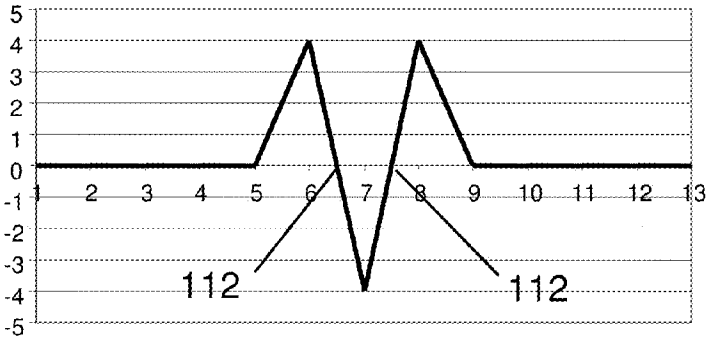

FIG. 15*a*-FIG. 15*d* depict an exemplary symmetrical triplet code pair based on a Barker 4a code. A first code 1502 of the pair is generated by adding a zero to each side of each element of the root code, 0,1,0 and 0,−1,0. A second code 1504 of the pair is generated by substituting three element symbols for each root code element, i.e., a 1 is substituted with 1,−1, 1, and a −1 is substituted with −1, 1, −1. The corresponding cross correlation functions for linear and cyclic implementations are shown in FIG. 15*b* and FIG. 15*c* respectively. Note that the off maximum cyclic values are zero. FIG. 15*d* shows the cross correlation function as in FIG. 15*c* with the first code rotated six positions. Cyclic Barker code correlation patterns may typically be rotated to any position by rotating one of the Barker codes.

Figure 16A:
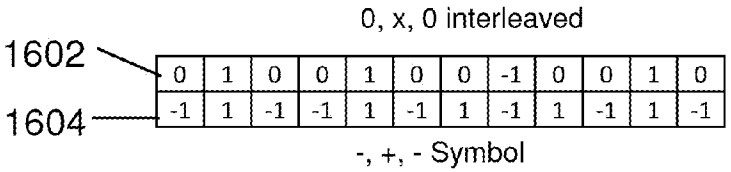
FIG. 16*a*-FIG. 16*c* depict an exemplary symmetrical triplet code pair based on a Barker 4a code.
Figure 16C:
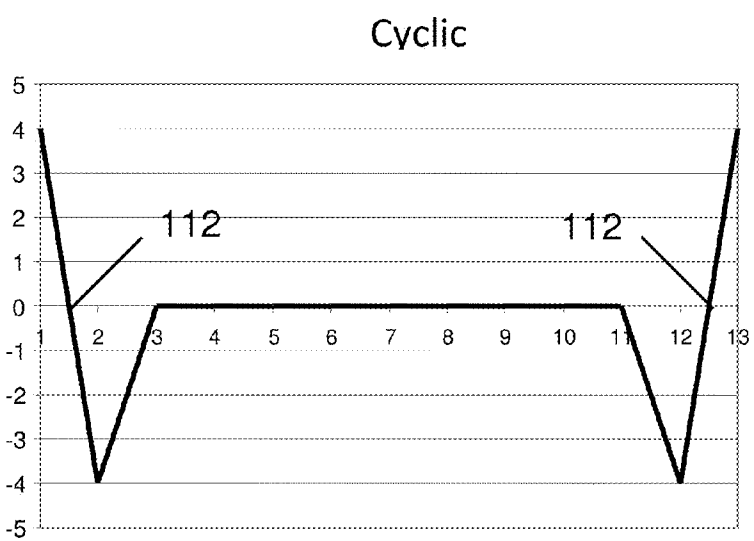
Figure 16B:
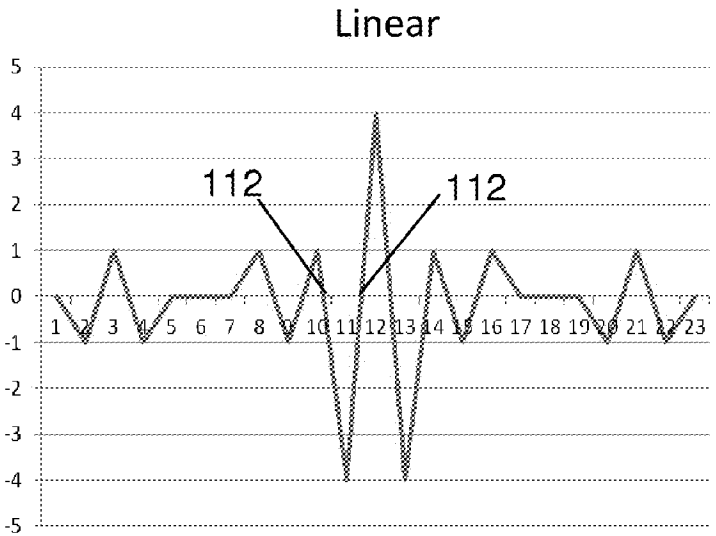

FIG. 16*a*-FIG. 16*c* depict an exemplary symmetrical triplet code pair based on a Barker 4a code. A first code 1602 of the pair is generated by adding a zero to each side of each element of the root code. A second code 1604 of the pair is generated by substituting three element symbols for each root code element, i.e., a 1 is substituted with 1,−1, 1, and a −1 is substituted with −1, 1, −1. The corresponding cross correlation functions for linear and cyclic implementations are shown in FIG. 16*b* and FIG. 16*c* respectively. Note that the off maximum cyclic values are zero. The correlation functions of FIG. 16 are the same as the correlation functions of FIG. 15 except they are inverted.

FIG. 17*a*-FIG. 17*c* depict an exemplary asymmetrical triplet code pair based on a Barker 4a code. A first code 1702 of the pair and a second code 1704 of the pair are generated by substituting three element symbols for each root code element, i.e., a 1 is substituted with 1,−1, 1, and a −1 is substituted with −1, 1, −1. The corresponding cross correlation functions for linear and cyclic implementations are shown in FIG. 17*b* and FIG. 17*c* respectively.

Figure 18A:
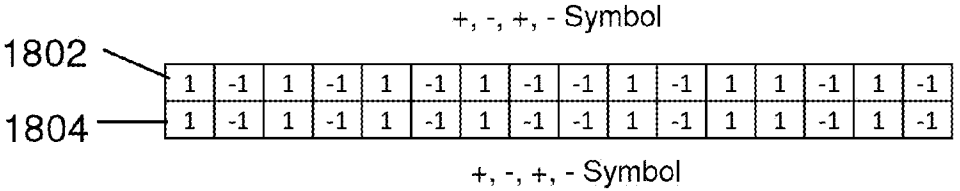
FIG. 18*a*-FIG. 18*c* depict an exemplary asymmetrical triplet code pair based on a Barker 4a code.
Figure 18C:
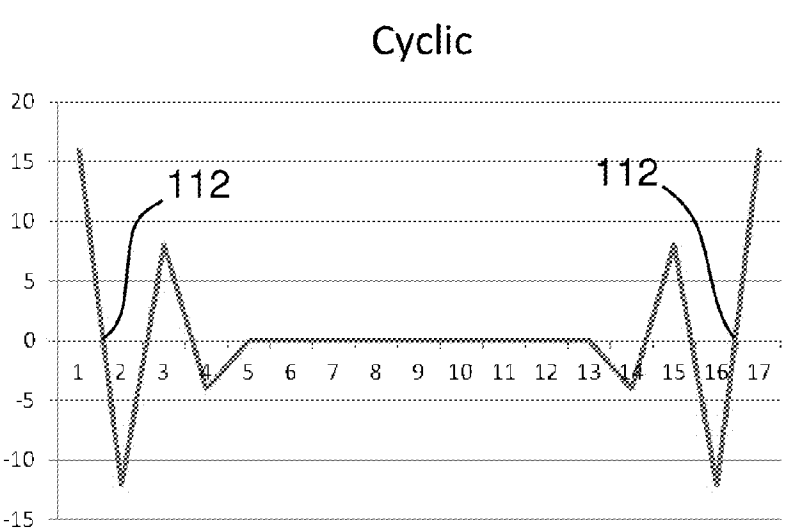
Figure 18B:
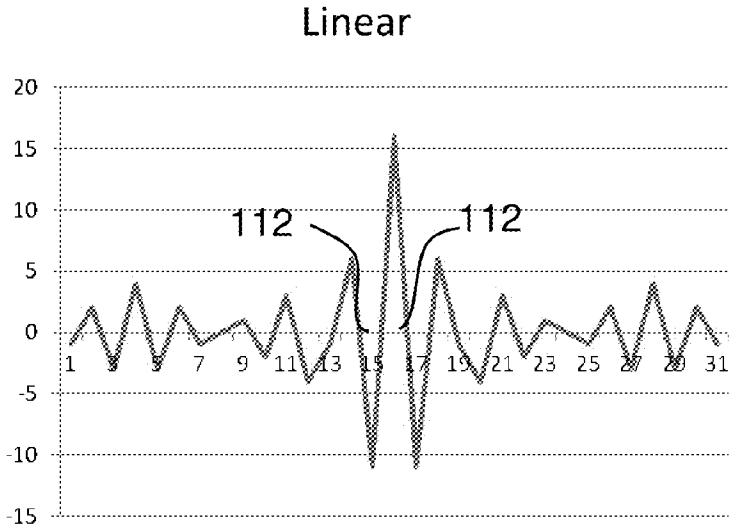

FIG. 18*a*-FIG. 18*c* depict an exemplary asymmetrical triplet code pair based on a Barker 4a code. A first code 1802 of the pair and a second code 1804 of the pair are generated by substituting four element symbols for each root code element, i.e., a 1 is substituted with 1,−1, 1, −1, and a −1 is substituted with −1, 1, −1, 1. The corresponding cross correlation functions for linear and cyclic implementations are shown in FIG. 18*b* and FIG. 18*c* respectively. Note that the off maximum cyclic values are zero.

Figure 19A:
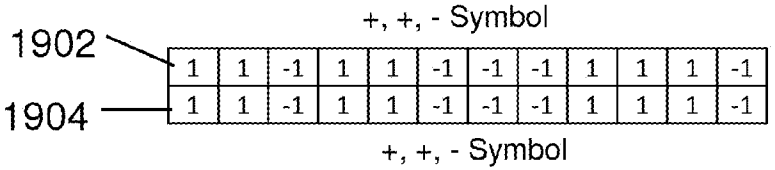
FIG. 19*a*-FIG. 19*c* depict an exemplary asymmetrical triplet code pair based on a Barker 4a code.
Figure 19C:
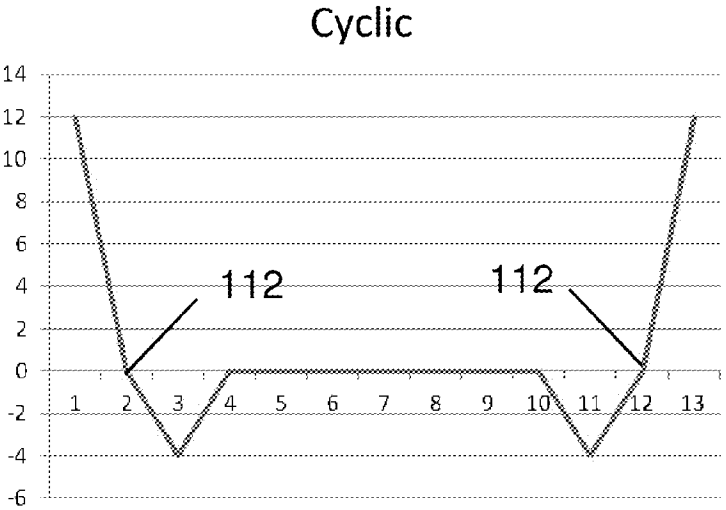
Figure 19B:
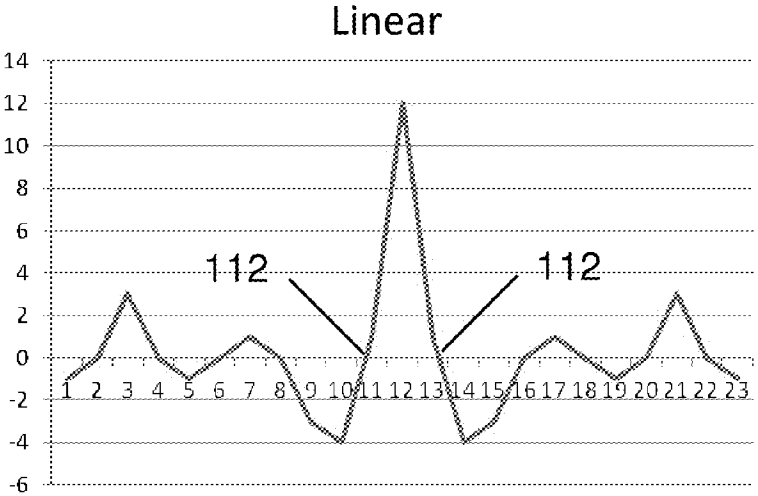

FIG. 19*a*-FIG. 19*c* depict an exemplary asymmetrical triplet code pair based on a Barker 4a code. A first code 1902 of the pair and a second code 1904 of the pair are generated by substituting a Barker 3 code for each root code element, i.e., a 1 is substituted with 1, 1, −1, and a −1 is substituted with −1, −1, 1. The corresponding cross correlation functions for linear and cyclic implementations are shown in FIG. 19*b* and FIG. 19*c* respectively.

The use of a Barker 3 symbol resulted in their not being a zero crossing between a peak attract lobe and a peak repel lobe as a result of force cancellation occurring at the symbol level within the Barker 4a code. Thus, although a Barker symbol could be used in accordance with the invention, it may sometimes be preferred that an alternating polarity symbol be used.

FIG. 20*a*-FIG. 20*c* depict an exemplary symmetrical four peak code pair based on a Barker 4a code. A first code 2002 of the pair is generated by adding three zeroes to after each element of the root code. A second code 2004 of the pair is generated by substituting four element symbols for each root code element, i.e., a 1 is substituted with 1,−1, 1, −1, and a −1 is substituted with −1, 1, −1, 1. The corresponding cross correlation functions for linear and cyclic implementations are shown in FIG. 20*b* and FIG. 20*c* respectively. Note that the off maximum cyclic values are zero.

Referring to FIG. 20*a*-FIG. 20*c*, multiple zero crossings are present as the result of multiple alternating polarity 'modulos' within the symbol. This characteristic is much like a polarity pattern of +− moving past a polarity pattern of +−+− in a linear implementation. There is ramp up and ramp down that occurs on the sides of the correlation function due to the number of interacting poles changing from 0 to 1 to 2 and vice versa but there are constant peaks in the middle of the correlation function due to there being two interfacing poles for three adjacent positions.

Arbitrary Force Pattern

In accordance with FIG. 20*a*-FIG. 20*c* and the previous figures, one can generalize that an arbitrary force pattern of maximum peaks of length n may be generated by modifying a root code having an impulse correlation to produce a first code comprising each root code element followed by zeroes of length n−1. A second code is generated by replacing each element of the root code with a symbol equal to the desired pattern multiplied by the value of the root code element. The length of the first or second code is the product of the desired pattern length and the root code length. The magnitude of the peak is typically the length of the root code or the number of populated (non-zero) values in the root code (e.g. Golomb 11 code has 5 populated values). For example, referring to FIG. 20*a*, the desired pattern is 1,−1,1,−1. The selected code is Barker 4a, 1,1,−1,1. The length of the resulting first or second code is the product of the length 4 code and length 4 pattern or 16. The length of the desired pattern of maximum peaks is 4—see FIG. 20*b*—note four maximum peaks of magnitude 4, the magnitude being equal to the length of the root code.

Magnet structures are then constructed in accordance with each code.

Coded Sensors

Coded magnet structures may be coupled with coded sensing structures to generate signals useful for various applications, for example but not limited to position sensing or pulse generation.

FIG. 21*a*-FIG. 21*d* depict an exemplary system of magnetic sensors configured for measuring field emissions from linear and cyclic magnetic structures. The sensors may be for example Hall effect sensors, flux gate sensors, magnetic force sensors or other magnetic sensors.

Figure 21A:
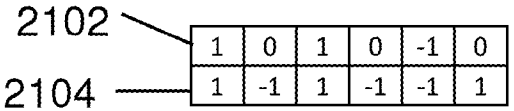
FIG. 21*a*-FIG. 21*c* depict an exemplary system of magnetic sensors configured for measuring field emissions from linear and cyclic magnetic structures.
Figure 21C:
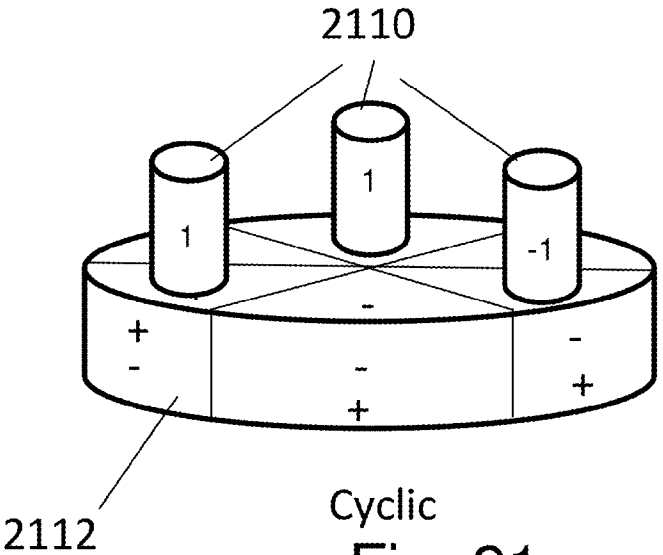
Figure 21B:
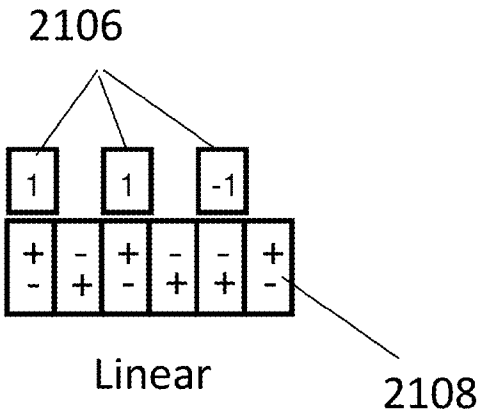

A first code 2102 and a second code 2104 are derived as in FIG. 1*a* based on a Barker 3 code, i.e., adding a zero for each Barker element to produce code 2102 and substituting 1, −1 or −1, 1 symbols for Barker elements to produce code 2104. Magnetic sensors are arranged according to the first code 2102 and magnetic field elements, e.g., magnets, are arranged according to the second code 2106. FIG. 21*b* shows a linear magnetic field structure 2108 and corresponding linear magnetic sensor structure 2106. Note that three magnetic sensors are shown for the six element code. This is because three of the code values are zero, thus eliminating the necessity of providing corresponding sensors whose signal would be multiplied by zero. In configuring a sensor system, the sensors or the magnets may be selected to correspond to the first code and the other would correspond to the second code. Since the first code contains zeroes, it may be advantageous to assign the more expensive elements to the first code. Thus, the sensors, being typically more expensive than the magnets, are selected to correspond to the first code. If the economics were reversed in a given case, or for other reasons, the choice may be reversed. FIG. 21*c* shows a circular magnetic field structure 2112 and a corresponding circular magnetic field arrangement. FIG. 21*c* also illustrates the use of three sensors to represent the six place code of 2102.

Referring to FIG. 21*b* and FIG. 21*c*, the magnets are rotated or moved to a particular position relative to the sensors and a correlation is performed. The output of each sensor represents the multiplication of the magnetic field element with the sensor sensitivity function. The sensor polarity outputs are configured according to the first code polarities. The sensor outputs are then summed to generate the correlation output.

Figure 21D:
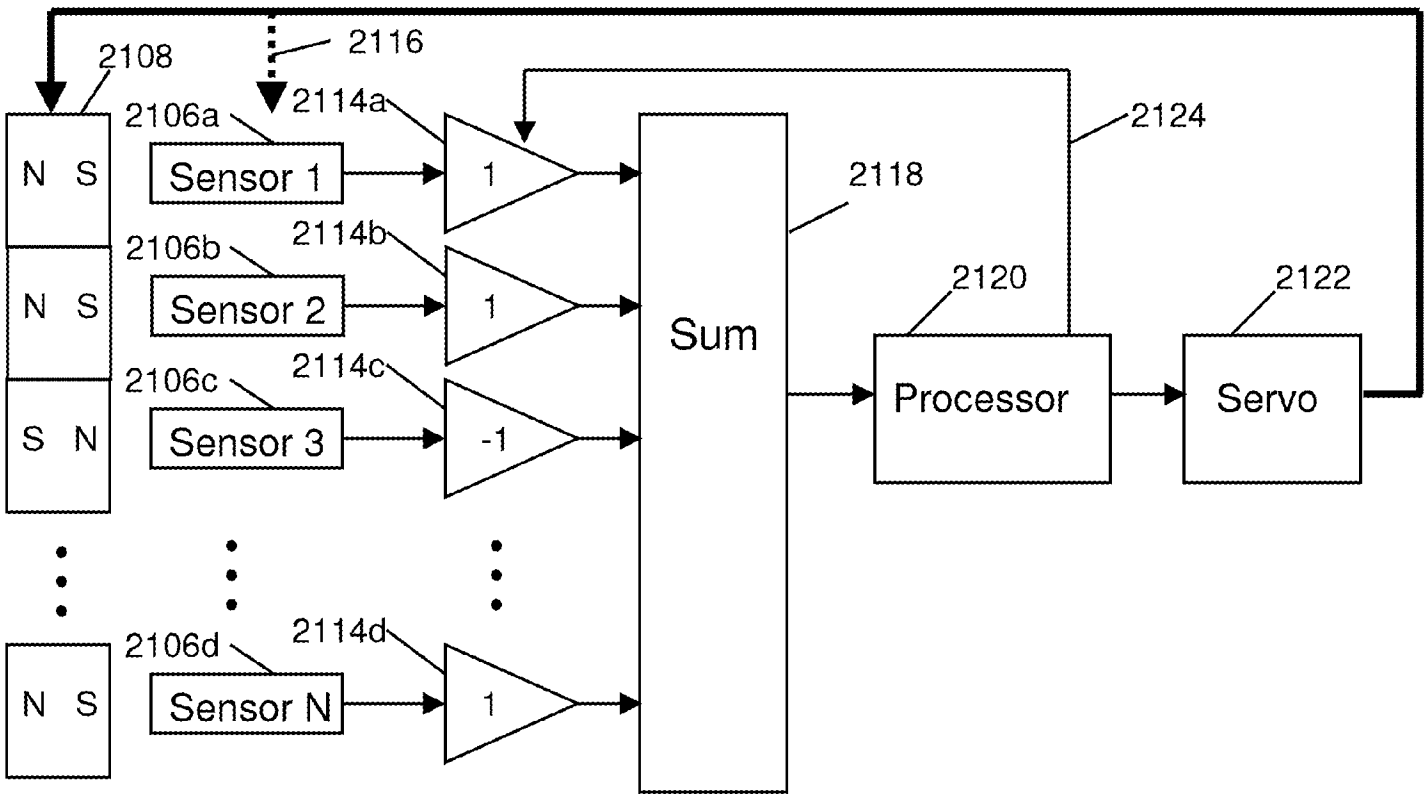
FIG. 21*d* depicts an exemplary control system using a sensor in accordance with the present disclosure.

FIG. 21*d* depicts an exemplary control system using a sensor in accordance with the present disclosure. Referring to FIG. 21*d*, a magnet assembly 2108 arranged in accordance with a first code is sensed by a sensor assembly comprising sensors 2106*a*-2106*d*. Each sensor is amplified by a respective gain stage 2114*a*-2114*d*. The respective gain stages may be configured in accordance with a second code. Thus gains may include polarity or zero states according to the code. The gain stage outputs are then summed in the summing stage 2118 to yield a correlation output, which is then fed to a processor 2120. Alternatively, gain, and sum functions 2118 may be performed by the processor 2120. The processor 2120 may then provide the output to a servo 2122, which may be coupled to the magnet assembly 2108 or the sensor assembly 2116 to drive the system to a desired alignment. For example, the system may use the sum signal as an error signal and drive the magnet assembly 2108 to a zero crossing alignment 112 as shown in FIG. 1*d*. In one variation, the processor may set 2124 the gain values of the respective gain stages 2114*a*-2114*d* to determine the sensor code and/or to rotate the sensor code.

In one variation, the sensor assembly response may be placed between a positive peak and a negative peak on the maximum slope (for example point 112, FIG. 1*d*). The correlation value may be then determined to determine a precise offset from the zero crossing and a feedback control signal may be generated to reduce the offset. The initial rough position may be determined by various methods. One exemplary method may comprise rotating the magnet structure around the complete circle using a stepping motor and measuring the correlation for each step. Then the position may be determined by observation of the full correlation data set to determine a positive and negative maximum point. The system may then be rotated to the zero crossing between the maximum positive and maximum negative to determine the precise zero crossing point. Thus, ambiguities among different zero correlation points may be eliminated. Alternatively, mechanical means maybe used to constrain operation around the desired zero crossing point to eliminate ambiguity with other zero correlation points.

In accordance with the present disclosure, zero crossings of a known waveform, for example a zero crossing between a peak attract and a peak repel may be used to determine the position of a magnetic structure relative to a sensor array. In accordance with one exemplary variation, symbols, for example 1, −1 and −1, 1, (+− and −+) may be used with codes having desirable autocorrelation characteristics such as Barker codes or pseudorandom codes to achieve a correlation function having, for example, a peak attract and a peak repel where the peak to off-peak ratio can be high and the peak attract and peak repel have the same amplitude or substantially the same amplitude and where the peak attract and peak repel lobes are adjacent lobes thereby producing a desirable zero crossing. For example, linear or cyclic magnetic structures having 26 chips in accordance with a Barker 13 code with +− and −+ symbols such as shown in FIG. 7*a* may have a peak to off-peak ratio of 13 to 1, where the slope between the adjacent peak attract and peak repel lobes is steep. To track the location of the magnetic structure, a sensor array of 13 Hall Effect sensors can be arranged such that the sensors are uniformly spaced over some distance, for example a distance of an inch, where the sensors would be 0.040" apart. The data from the sensors could be processed in accordance with a Barker 13 code, where data from certain sensors would be multiplied by −1 per the code prior to being added. The signal-to-noise ratio (SNR) required to track the zero crossing to 0.001" accuracy using the array would be approximately 26 dB. Alternatively, the symbols 1, −1 and −1, 1 could be reversed in which case the correlation functions of the linear and cyclic implementations would invert such as previously described in relation to the Barker 4a code implementations of FIG. 15 and FIG. 16.

In one variation, a sliding correlation algorithm could be employed to track the magnetic structure over the full length of the sensor array, where multiple parallel calculations corresponding to the number of wraps of the code would be calculated, which for a Barker 13 code would be 13 calculations. Alternatively, multiple sensor arrays offset from each other could be employed.

Further Variations

Figure 22A:
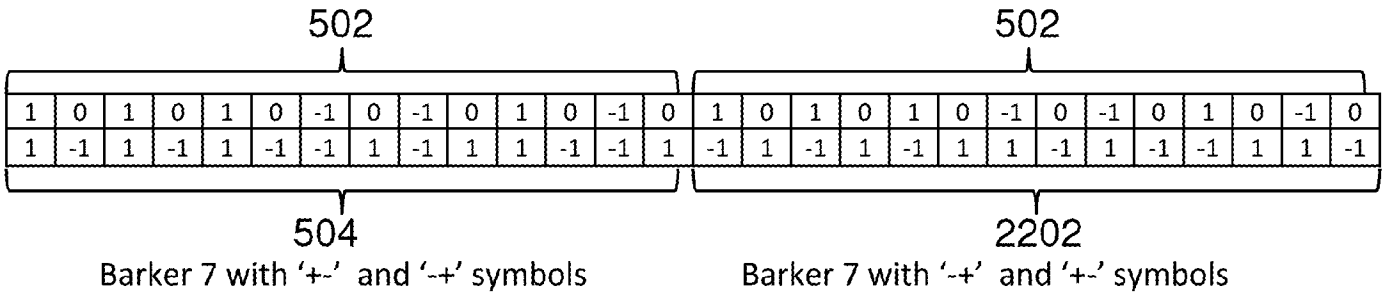
FIG. 22*a*-FIG. 22*c* show various exemplary parallel and series combinations of codes.
Figure 22B:
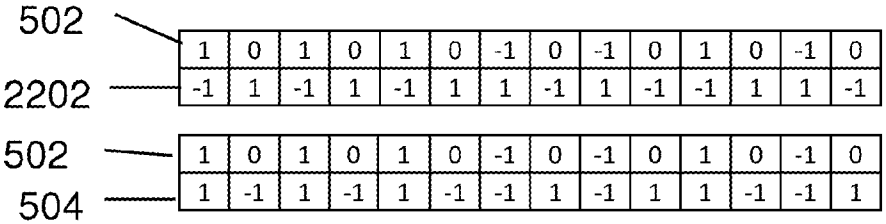

FIG. 22*a*-FIG. 22*d* show various exemplary parallel and series combinations of codes. In one variation, a first magnetic structure of a given code, for example a Barker 7 code, having '+−' and '−+' symbols is added in parallel as shown in FIG. 22*b* or in series with a second magnetic structure, as shown in FIG. 22*a*, in accordance with the same code but having the opposite symbols '−+' and '+−'. Referring to FIG. 22*a*, the top code is derived from linking two copies of the Barker 7 code modified with the 1,0 symbol (502) as in FIG. 5*a*. The bottom code is formed by linking in series a Barker 7 code modified with the 1, −1 symbol (504) as in FIG. 5*a* with an opposite polarity copy (2202), i.e., a Barker 7 code modified with the −1,1 symbol.

Figure 22C:
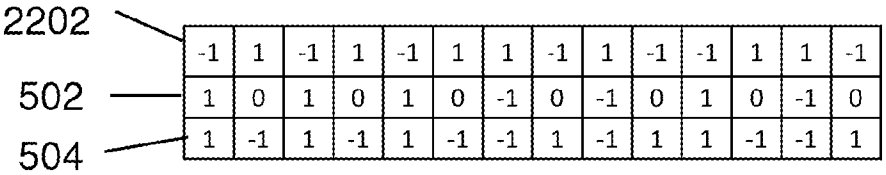

Referring to FIG. 22*b*, the top code pair 502, 2202 is the right hand pair from FIG. 22*a* and the bottom pair 502,504 is the left hand pair from FIG. 22*a*. Thus the two halves of FIG. 22*a* are shown in parallel in FIG. 22*b*. FIG. 22*c* shows the single code 502 between the opposite polarity codes 504 and 2202.

Figure 23A:
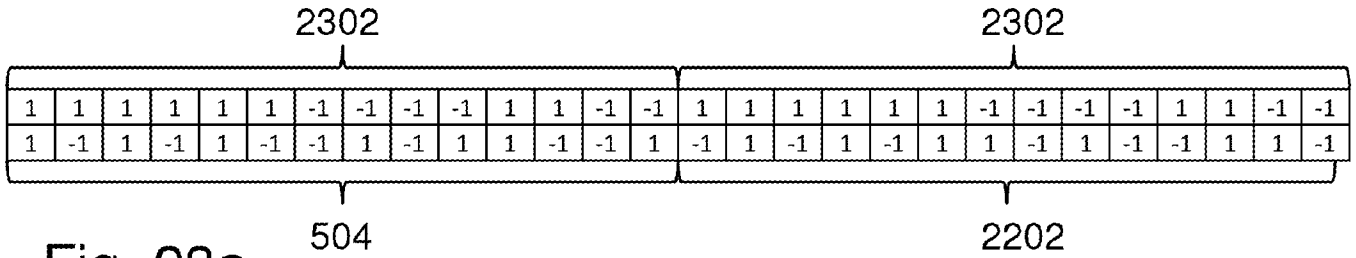
FIG. 23*a*-FIG. 23*c* show various other implementations involving Barker 7 arrays.
Figure 23B:
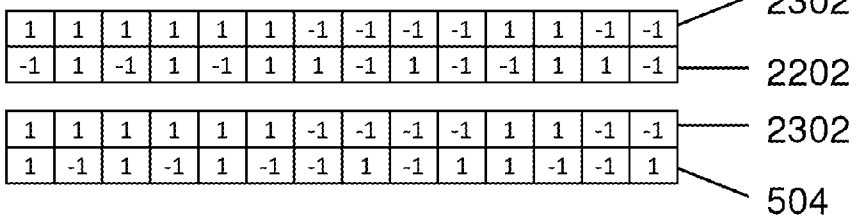
Figure 23C:
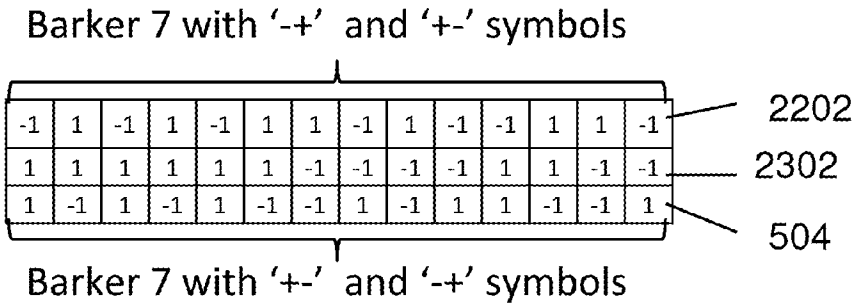

With these arrangements (FIG. 22*a* through FIG. 22*c*), the net Z axis force (vertical as shown on the page) is zero while the restorative force along the code (horizontal on the page) is substantial, which could be used to enable various applications such as high torque/shear coupling devices that have substantially zero tensile force across an interface boundary. Various implementations involving spaced Barker 7 arrays and Barker 7 arrays having '+−' and '−+' symbols opposing spaced Barker 7 arrays and Barker 7 arrays having '−+' and '+−' symbols are shown in FIGS. 22*a*-22*c*. It should be noted that the two halves of the array of FIG. 22*a* can be separated (space between them) where maxels (i.e., magnetic elements) from the two halves cannot interact, i.e., where the magnetic elements from a first code sequence do not shift far enough to interact with the magnetic elements of the complementary code from the second code sequence, during operation. Various other implementations involving Barker 7 arrays having '++' and '−−' symbols 2302 and Barker 7 arrays having '+−' and '−+' symbols 504 opposing Barker 7 arrays having '++' and '−−' symbols 2302 and Barker 7 arrays having '−+' and '+−' symbols 2202 are shown in FIGS. 23*a*-23*c*. It should be noted that the two halves of the array of FIG. 23*a* can be separated where maxels from the two halves cannot interact.

Figure 22D:
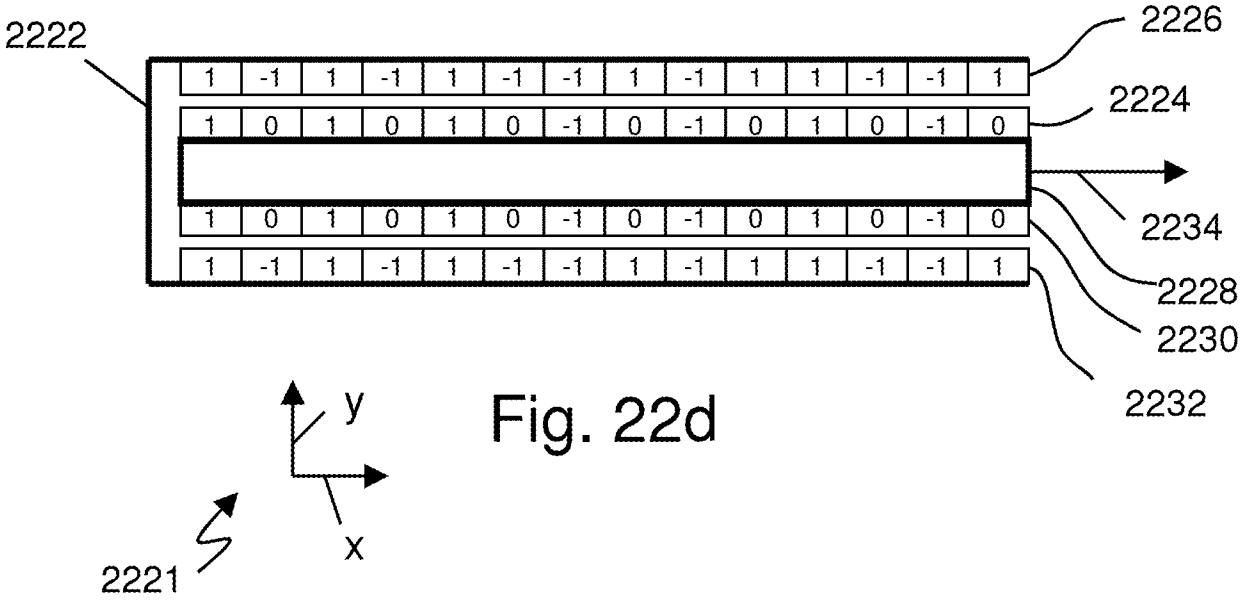
FIG. 22*d* illustrates an exemplary magnet structure having a strong shear force and a neutral normal force.

FIG. 22*d* illustrates an exemplary magnet structure having a strong shear force and a neutral normal force. Referring to FIG. 22*d*, axes 2221 show a positive x and positive y direction for discussion reference. A first rigid frame 2222 has a first coded magnet structure 2226 and a fourth coded magnet structure 2232 disposed thereon on opposite sides. A second frame 2228 has a second coded magnet structure 2224, and a third coded magnet structure 2230 disposed thereon on opposite sides. The first coded magnet structure 2226 on frame 2222 interacts with a second coded magnet structure 2224 on frame 2224 to produce a first force function. The third magnet structure 2230 on frame 2224 interacts with the fourth magnet structure 2232 on frame 2222 to produce a second force function. The first force function and the second force function comprise forces normal to the sequence of the magnet structures as a function of relative displacement of the two frames in a direction 2234 parallel to the magnet sequence. As shown in FIG. 22*d*, the first and fourth codes may be the same, and the second and third codes may be the same. It can be appreciated that a peak attraction alignment of the first and second codes would produce a force on the second frame in the positive y direction. Also, the same alignment of the third and fourth codes would produce force on the second frame in the negative y direction. With equal magnet strengths, the y direction forces would be equal and cancel because the two code pairs have the same cross correlation functions. Thus, for any shift position, the y forces are equal and opposite and therefore cancel.

In contrast, the lateral position forces sum to double the value of one alone. One can appreciate this property by observing a lateral displacement of the second frame by one half of a code position in the positive x direction. Observe that each 1 in the second code is diagonally below and to the right of a 1 in the first code and below and left of a −1, creating a restoring force to the left (negative x direction) on frame 2 (using a convention that a 1×1 code product represents attraction and a 1x−1 product represents repelling). The −1 values are below and right of −1 values, also creating a left restoring force Likewise, the third and fourth codes can be seen to produce a restoring force to the left that sum with those from the first and second codes. Thus the structure can produce parallel forces along the direction of the magnet sequence while balancing the normal forces to zero.

Figure 24A:
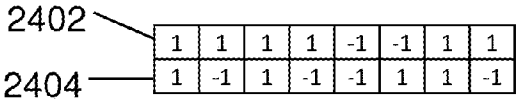
FIG. 24*a*-FIG. 24*d* depict an exemplary code pair based on a Barker 4a root code.
Figure 24B:
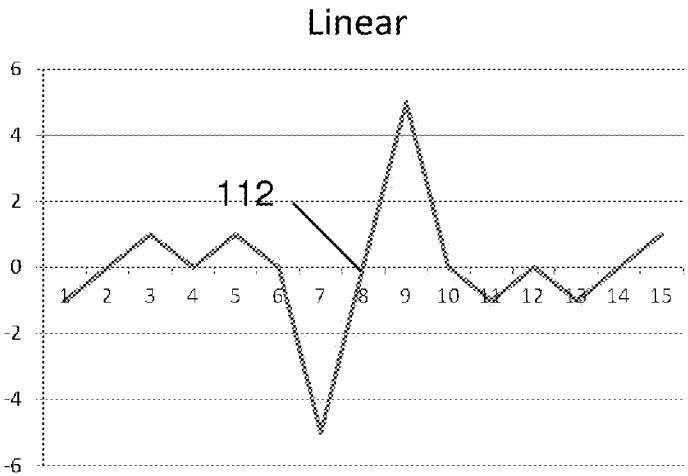
Figure 24C:
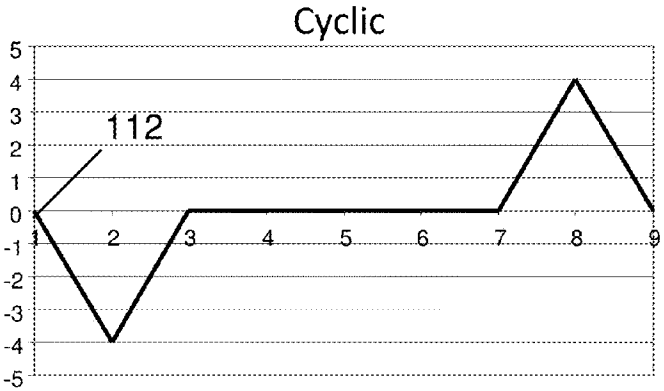
Figure 24D:
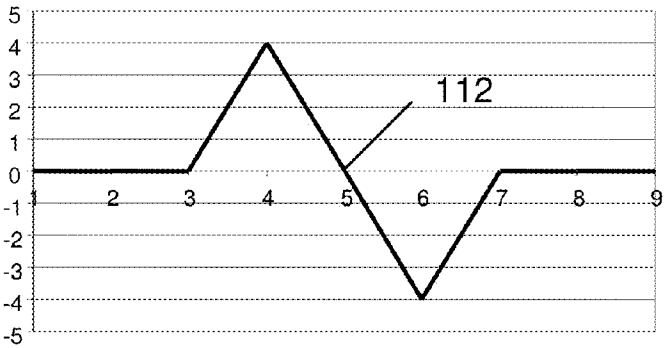

FIG. 24*a*-FIG. 24*d* depict an exemplary code pair based on a Barker 4a root code. The code pair comprises a first code 2402 and a second code 2404. The first code is derived by substituting 1, 1 symbols for 1 and substituting −1, −1 symbols for −1 values in the root code. The second code is derived by substituting 1, −1 symbols for 1 values and −1, 1 symbols for −1 values in the root code. FIG. 24*b* shows a corresponding linear correlation function and FIG. 24*c* shows a corresponding cyclic correlation function. The correlation functions have a zero crossing at one of the code positions rather than between code positions as with, for example FIG. 1*a* through FIG. 7*c*. The maximum peak negative (repel) and maximum peak positive (attract) values are at the code positions on either side of the zero crossing position. The code arrangement of FIG. 24*a* corresponds to position 8 on the graph of FIG. 24*b* and position 1 of the graph of FIG. 24*c*. FIG. 24*d* shows the cyclic correlation of FIG. 24*c* with the first code shifted four positions.

FIG. 25*a*-FIG. 25*c* depict two codes 2502 and 2504 derived from the two codes of FIG. 24*a*, 2402 and 2404, where each '+' symbol has been replaced by a '+−' symbol and each '−' symbol has been replaced by a '−+' symbol, and corresponding correlation functions for linear and cyclic implementations. As before, the correlation functions have a zero crossing when fully aligned but now oscillated between the two peaks in a saw tooth fashion as result of the added symbols. Generally, the process of replacing '+' symbols with '+−' symbols and '−' symbols with '−+' symbols can be repeated over and over to add more and more saw tooth like behavior on top of the underlying codes. Moreover, one could replace '+' symbols with '−+' symbols and '−' symbols with '+−' symbols for a given layer. And as described previously, a given symbol (e.g., '+') can be replaced with any polarity pattern (e.g., a Barker 3 code) as long as the opposite symbol (e.g., '−') is replaced with the opposite polarity pattern.

Figure 26A:
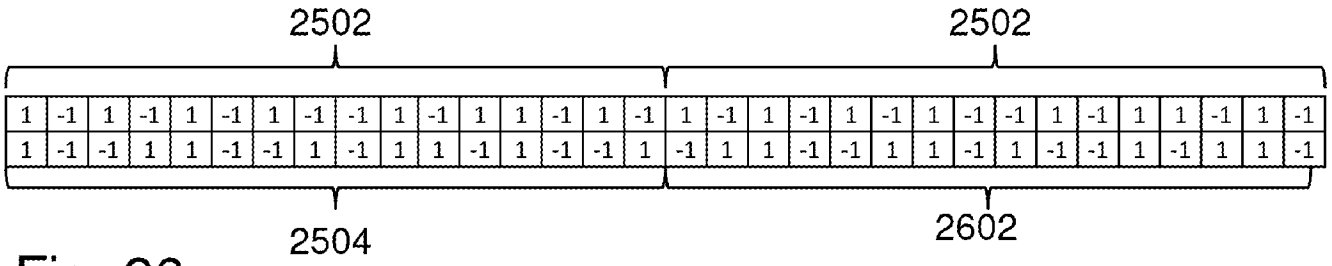
FIG. 26*a*-FIG. 26*c* depict the same concept described in relation to FIG. 22*a*-FIG. 22*c* and FIG. 23*a*-FIG. 23*c* except using the codes from FIG. 25.
Figure 26B:
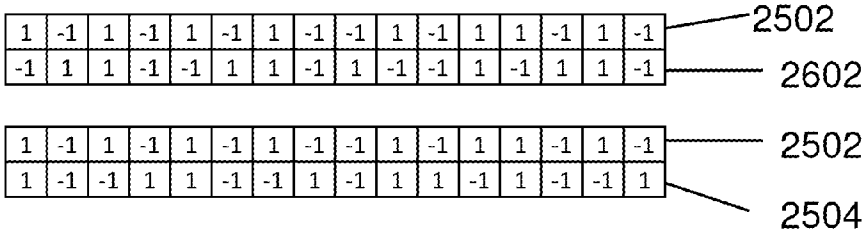
Figure 26C:
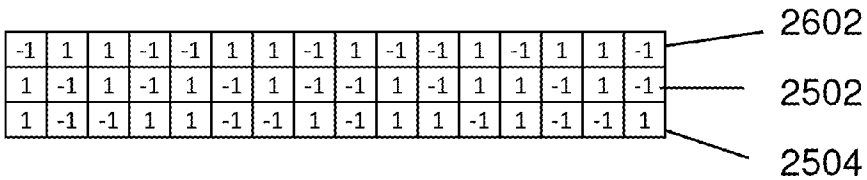

FIG. 26*a*-FIG. 26*c* depict the same concept described in relation to FIG. 22*a*-FIG. 22*c* and FIG. 23*a*-FIG. 23*c* except using the codes from FIG. 25. Code 2602 is the opposite polarity from code 2504.

In accordance with still another alternative embodiment of the invention, combinations of magnetic structures and coils, where the magnetic structures are moved relative to the coils (and/or vice versa), produce a correlation function having adjacent peak attract and peak repel lobes like shown for the cyclic implementation of the Barker 13 based code of FIG. 7. The correlation functions correspond to a zero mean waveform that can be used for transformers, spark coils, spark plug drivers, igniters, and other such high peak power applications. Other example applications include 2 cycle engines, position determination systems, and guidance control systems and the like such as described in U.S. Pat. No. 8,115,581.

Figure 27A:
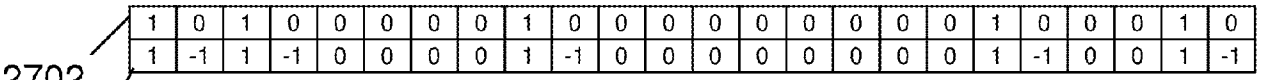
FIG. 27*a*-FIG. 27*d* depict an exemplary code pair based on a Golomb ruler size 11 code.
Figure 27B:
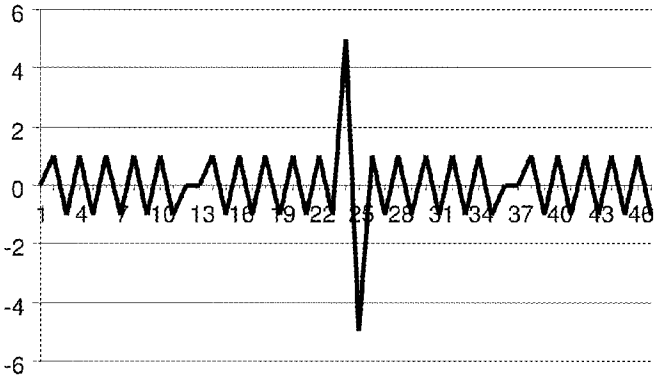

FIG. 27*a*-FIG. 27*d* depict an exemplary code pair based on a Golomb ruler size 11 code. (110010000101). The Golomb rulers typically number the bit positions 0 through n−1. So, the Golomb 11 code has 12 positions. For the example, the first code 2702 is a zero interleaved code. The second code 2704 substitutes 1, −1 or 0, 0 for each 1 or 0 in the root code. The resulting codes are shown in FIG. 27*a*. FIG. 27*b* shows the linear, non-cyclic cross correlation. A sharp doublet correlation spike of magnitude 5 can be seen in the center of the pattern. The Golomb 11 has 5 populated positions. The non maximum peak values in the background are magnitude 1 or less.

Figure 27C:
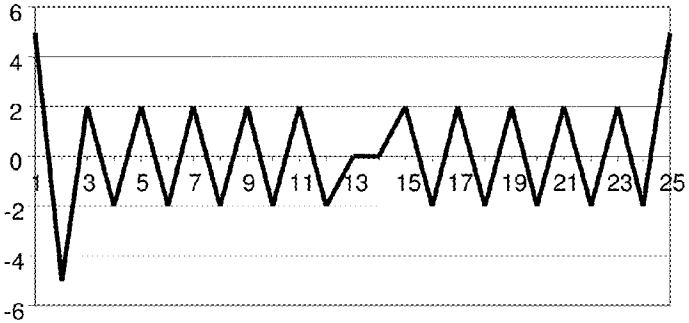
Figure 27D:
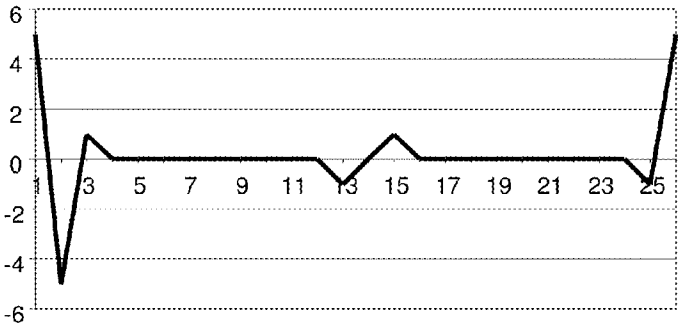

FIG. 27*c* shows the Golomb 11 operated as a cyclic code with a copy of the code following directly after the first code instance. The resulting correlation diagram is shown in FIG. 27*c*. The peak correlation is the same as FIG. 27*b* at +5 and −5, however, the off peak values vary from +2 to −2. FIG. 25*c* shows the cyclic correlation with a length of 24. If the codes 2702 and 2703 are further modified by adding an additional 0 at the end to make a 25 length code, the modified autocorrelation is as shown in FIG. 27*d*. Note the off peak correlation is mostly zero with only two 1 and −1 values.

CONCLUSION

Whereas the various examples have been described, it should be understood that one of ordinary skill in the art may modify the examples in accordance with the teachings herein. Codes have been discussed in relation to magnetic fields of a given polarity. It will be noted that the assignment of a magnetic field polarity to a numerical polarity is arbitrary and either polarity may be assigned as long as the assignment is consistently applied. Magnetic structures may be designed for magnetic attraction, and conversely the same structures may be also designed for repelling forces by reversing one of the magnetic assemblies.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A system for positioning a part comprising:

a first magnetic assembly comprising a plurality of magnetic field devices, said magnetic field devices arranged according to a first code, said first code derived from a source code by replacing each source code element by a product of the source code element and a first symbol, said first symbol having at least two elements, at least one element is nonzero;

said source code having an autocorrelation function with a single maximum magnitude and a maximum off maximum peak value less than half of the single maximum magnitude;

a second magnetic assembly comprising a second plurality of magnetic field devices, said magnetic field devices arranged according to a second code, said second code derived from said source code by replacing each source code element by a product of the source code element and a second symbol, said second symbol having at least two values, at least one value is nonzero;

wherein the first symbol and second symbol have the same length.

2. The system in accordance with claim 1, wherein the first symbol is 1, 0.

3. The system in accordance with claim 1, wherein the second symbol is 1, −1.

4. The system in accordance with claim 1, wherein the first symbol is 1, 0, 0.

5. The system in accordance with claim 1, wherein the second symbol is 1, −1, 1.

6. The system in accordance with claim 1, wherein the first symbol and second symbol are the same value.

7. The system in accordance with claim 1, wherein the source code is a Barker code, a PN code, or a Golomb ruler code.

8. The system in accordance with claim 1, wherein the second magnetic field device is a magnetic sensor.

9. The system in accordance with claim 8, further comprising a feedback mechanism configured to maintain a position based on said magnetic sensor.

10. The system in accordance with claim 1, wherein the second magnetic field device is a magnetic source.

11. The system in accordance with claim 10, wherein the magnetic source is a permanent magnet.

12. The system in accordance with claim 10, wherein the magnetic source comprises at least one electromagnet.

13. The system in accordance with claim 10, wherein the system comprises a stepping motor.

14. The system in accordance with claim 10, wherein the second magnetic field device comprises at least one inductor configured to produce an electrical pulse in response to a relative movement of said first magnetic assembly and said second magnetic assembly.

15. A method for generating a magnetic field force profile comprising:

providing a source code having source code elements;

generating a first code by replacing each source code element of said source code with a product of the source code element and a first symbol, said first symbol having at least two elements, at least one element is nonzero;

generating a second code by replacing each source code element of said source code with a product of the source code element and a second symbol, said second symbol having at least two elements, at least one element is nonzero;

said source code having an autocorrelation function with a single maximum magnitude and a maximum off maximum peak value less than half of the single maximum magnitude;

arranging a first magnetic assembly of magnetic elements in accordance with said first code;

arranging a second magnetic assembly of magnetic elements in accordance with said second code;

positioning said first magnetic assembly in proximity to said second magnetic assembly across an interface boundary; and moving said first magnetic assembly relative to said second magnetic assembly in accordance with a path maintaining an alignment between said first magnetic assembly and said second magnetic assembly to produce a force function related to a cross correlation function of said first code and said second code.

16. The method in accordance with claim 15, wherein the first symbol is 1,0.

17. The method in accordance with claim 15, wherein the second symbol is 1, −1.

18. The method in accordance with claim 15, wherein the first symbol is 1,0,0.

19. The method in accordance with claim 15, wherein the second symbol is 1, −1, 1.

20. The method in accordance with claim 15, wherein the source code is a Barker code, a PN code, or a Golomb ruler code.

21. The method in accordance with claim 15, further including a step: rotating said first code or said second code.

22. The method in accordance with claim 15, further including a step: increasing or decreasing a length of the first code.

23. The method in accordance with claim 15, wherein the second symbol is a compound symbol generated by replacing elements of a third symbol in accordance with a product of the elements of the third symbol and a fourth symbol.

* * * * *